US010898770B2

(12) United States Patent
Matsunaga et al.

(10) Patent No.: US 10,898,770 B2
(45) Date of Patent: Jan. 26, 2021

(54) GOLF CLUB HEAD

(71) Applicant: Sumitomo Rubber Industries, Ltd., Hyogo (JP)

(72) Inventors: Kiyofumi Matsunaga, Kobe (JP); Yasushi Sugimoto, Kobe (JP); Yuki Motokawa, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/585,501

(22) Filed: Sep. 27, 2019

(65) Prior Publication Data

US 2020/0121997 A1 Apr. 23, 2020

(30) Foreign Application Priority Data

Oct. 17, 2018 (JP) ..... 2018-196225

(51) Int. Cl.
*A63B 53/04* (2015.01)
*A63B 53/00* (2015.01)

(52) U.S. Cl.
CPC ..... *A63B 53/047* (2013.01); *A63B 53/007* (2013.01); *A63B 53/0408* (2020.08); *A63B 53/0433* (2020.08); *A63B 53/0466* (2013.01)

(58) Field of Classification Search
CPC ..... A63B 53/0475; A63B 53/047; A63B 53/0466; A63B 2053/0433; A63B 2053/0408; A63B 53/007
See application file for complete search history.

(56) References Cited

U.S. PATENT DOCUMENTS 5,346,216 A * 9/1994 Aizawa ..... A63B 53/04 473/329
6,660,960 B2 * 12/2003 Takeda ..... A63B 53/047 219/121.64
7,140,974 B2 * 11/2006 Chao ..... A63B 53/0466 473/329
7,357,730 B2 * 4/2008 Shieh ..... A63B 53/0475 473/342
RE42,544 E * 7/2011 Chao ..... A63B 53/0466 473/329
8,096,897 B2 * 1/2012 Beach ..... A63B 60/00 473/345
RE43,801 E * 11/2012 Chao ..... A63B 53/0466 473/329
8,303,435 B2 * 11/2012 Chao ..... A63B 53/0466 473/342

(Continued)

FOREIGN PATENT DOCUMENTS

JP 5708870 B1 4/2015

*Primary Examiner* — Stephen L Blau
(74) *Attorney, Agent, or Firm* — Studebaker & Brackett PC

(57) ABSTRACT

A head includes a head body and a face plate. The face plate includes a plate front surface and a plate rear surface. The head body includes an opening at which the face plate is disposed, a back support portion that includes a back receiving surface abutting on an outer peripheral edge portion of the plate rear surface and that supports the face plate from a back side, a face outer portion that is a part of a hitting face and that is located on a face peripheral side relative to the plate front surface, and a body groove that is located on the back side of the face outer portion and that is recessed toward the face outer portion.

18 Claims, 22 Drawing Sheets

(56) References Cited

U.S. PATENT DOCUMENTS

| | | | | |
|---|---|---|---|---|
| 9,028,341 | B2 * | 5/2015 | Lorentzen | A63B 53/0466 473/342 |
| 9,278,267 | B2 * | 3/2016 | Chao | A63B 60/00 |
| 9,457,243 | B2 * | 10/2016 | Lorentzen | A63B 53/02 |
| 9,682,297 | B2 * | 6/2017 | Lorentzen | A63B 53/02 |
| 10,076,692 | B2 * | 9/2018 | Gilbert | A63B 53/0475 |
| 2011/0275451 | A1 * | 11/2011 | Chao | A63B 53/0466 473/330 |
| 2015/0031471 | A1 * | 1/2015 | Su | A63B 53/0475 473/329 |
| 2017/0239533 | A1 * | 8/2017 | Cole | A63B 53/0475 |

* cited by examiner

GOLF CLUB HEAD

This application claims priority on Patent Application No. 2018-196225 filed in JAPAN on Oct. 17, 2018. The entire contents of this Japanese Patent Application are hereby incorporated by reference.

BACKGROUND OF THE INVENTION

Field of the Invention

The present disclosure relates to golf club heads.

Description of the Related Art

There has been known a head that includes a head body and a face plate fixed to the head body. JP5708870B1 discloses an iron-type golf club head that includes: a plate-shaped face member having a face surface and a face back surface; and a head body having a frame part that holds an outer peripheral portion of the face member. In this head, the frame part includes a support wall portion having a receiving surface that can abut on an outer peripheral portion of the face back surface, and the support wall portion has at least one aperture.

SUMMARY OF THE INVENTION

The present inventors have found a new structure capable of enhancing rebound performance of a head including a face plate.

The present disclosure provides a new structure that enhances rebound performance of a head including a face plate.

A golf club head according to one aspect includes a head body including a sole, and a face plate fixed to the head body. The face plate includes a plate front surface that forms a part of a hitting face, and a plate rear surface that is a surface opposite to the plate front surface. The head body includes an opening at which the face plate is disposed, a back support portion that includes a back receiving surface abutting on an outer peripheral edge portion of the plate rear surface and that supports the face plate from a back side, a face outer portion that is a part of the hitting face and that is located on a face peripheral side relative to the plate front surface, and a body groove that is located on the back side of the face outer portion and that is recessed toward the face outer portion.

DESCRIPTION OF THE PREFERRED EMBODIMENTS

In the present application, the following terms are defined.

[Toe-Heel Direction]

The extending direction of a longest face line is defined as a toe-heel direction. The meanings of the terms "toe side" and "heel side" in the present application are interpreted based on this toe-heel direction.

[Up-Down Direction]

A direction that is parallel to a hitting face and that is perpendicular to the toe-heel direction is defined as an up-down direction. In the present application, the meanings of the terms "upper side" and "lower side" are interpreted based on this up-down direction.

[Face-Back Direction]

A direction perpendicular to the hitting face is defined as a face-back direction. When the hitting face is a curved surface, a direction of a line normal to the hitting face at a face center is defined as a face-back direction. The meanings of the terms "face side" and "back side" in the present application are interpreted based on this face-back direction.

[Face Center]

On the center position in the toe-heel direction of the longest face line, the center position in the up-down direction of the hitting face is the face center.

[Face Peripheral Side]

A face peripheral side in the present application is defined as a concept that means positions being away from the center of a head. In a sole-side region of the head, the face peripheral side means the lower side. In a top-side region of the head, the face peripheral side means the upper side. In a toe-side region of the head, the face peripheral side means the toe side. In a heel-side region of the head, the face peripheral side means the heel side.

[Face Center Side]

In the present application, a face center side is defined as a term that means positions being closer to the center of the head. In the sole-side region of the head, the face center side means the upper side. In the top-side region of the head, the face center side means the lower side. In the toe-side region of the head, the face center side means the heel side. In the heel-side region of the head, the face center side means the toe side. The term "face center side" is the antonym of "face peripheral side".

[Sole-Side Region, Top-Side Region, Toe-Side Region, and Heel-Side Region]

As to portions of the head, it may be difficult to determine which of the sole side, the top side, the toe side, and the heel side, the portion concerned belongs to. In this case, the sole-side region, the top-side region, the toe-side region, and the heel-side region can be defined using planes Pa, Pb, Pc, and Pd as references as shown below.

Figure 1:
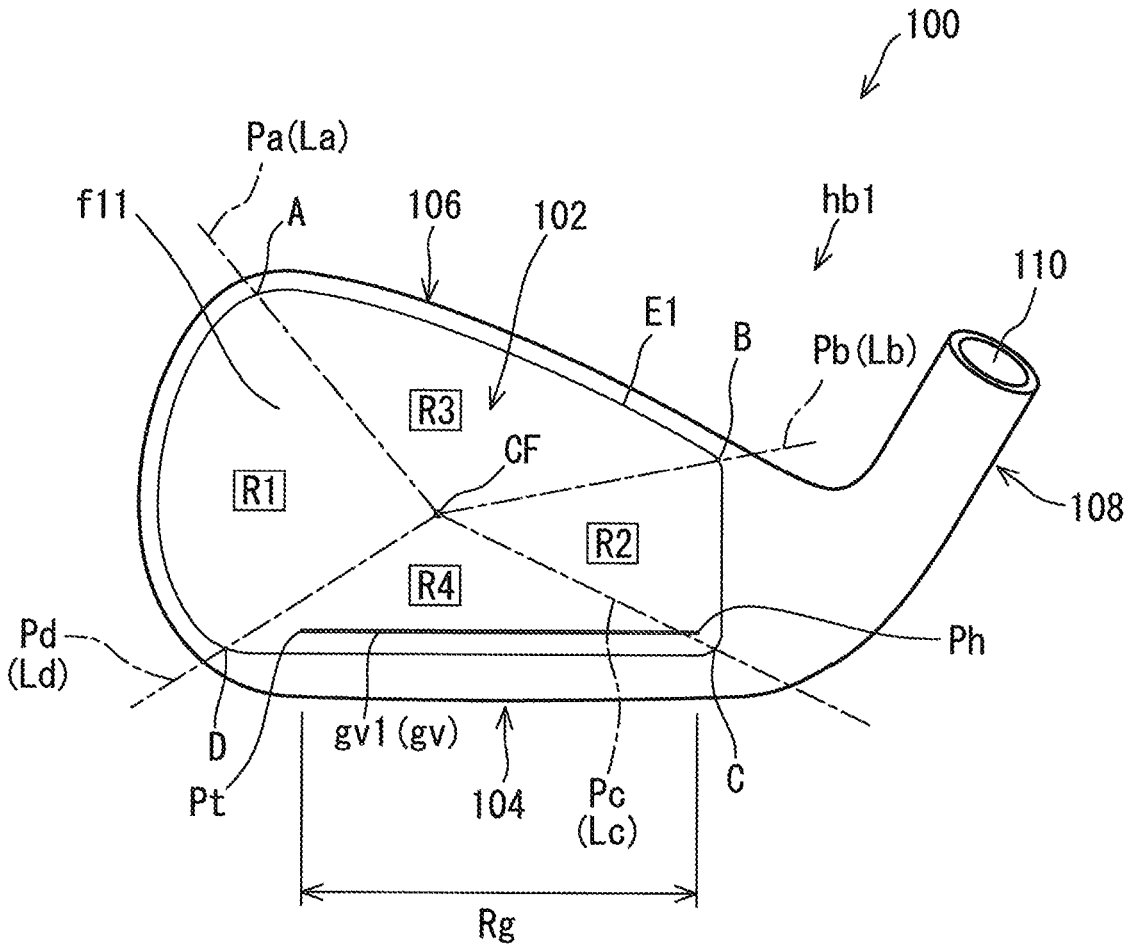
FIG. 1 is a front view of a golf club head according to a first embodiment.

As shown in FIG. 1, straight lines La, Lb, Lc, and Ld can be drawn from a centroid CF of a plate front surface f11. The straight line La is a straight line that connects the centroid CF and a point A. The straight line Lb is a straight line that connects the centroid CF and a point B. The straight line Lc is a straight line that connects the centroid CF and a point C. The straight line Ld is a straight line that connects the centroid CF and a point D. The point A is a point having a curvature radius of smallest in a part of an outer edge line E1 which is present in a toe upper region. The toe upper region means a region located on the toe side and on the upper side with respect to the centroid CF of the plate front surface f11. The point B is a point having a curvature radius of smallest in a part of the outer edge line E1 which is present in a heel upper region. The heel upper region means a region located on the heel side and on the upper side with respect to the centroid CF of the plate front surface f11. The point C is a point having a curvature radius of smallest in a part of the outer edge line E1 which is present in a heel lower region. The heel lower region means a region located on the heel side and on the lower side with respect to the centroid CF of the plate front surface f11. The point D is a point having a curvature radius of smallest in a part of the outer edge line E1 which is present in a toe lower region. The toe lower region means a region located on the toe side and on the lower side with respect to the centroid CF of the plate front surface f11. The outer edge line E1 is the outer edge line of the plate front surface f11, and is present on a hitting face 102.

The plane Pa is defined as a plane that includes the straight line La and is perpendicular to the plate front surface f11. The plane Pb is defined as a plane that includes the straight line Lb and is perpendicular to the plate front surface f11. The plane Pc is defined as a plane that includes the straight line Lc and is perpendicular to the plate front surface f11. The plane Pd is defined as a plane that includes the straight line Ld and is perpendicular to the plate front surface f11. These four planes Pa, Pb, Pc, and Pd can compart a head, a head body, a first member, and a face plate into a toe-side region R1, a heel-side region R2, a top-side region R3, and a sole-side region R4 (see FIG. 1).

The following will describe embodiments in detail with appropriate reference to the drawings.

Figure 2:
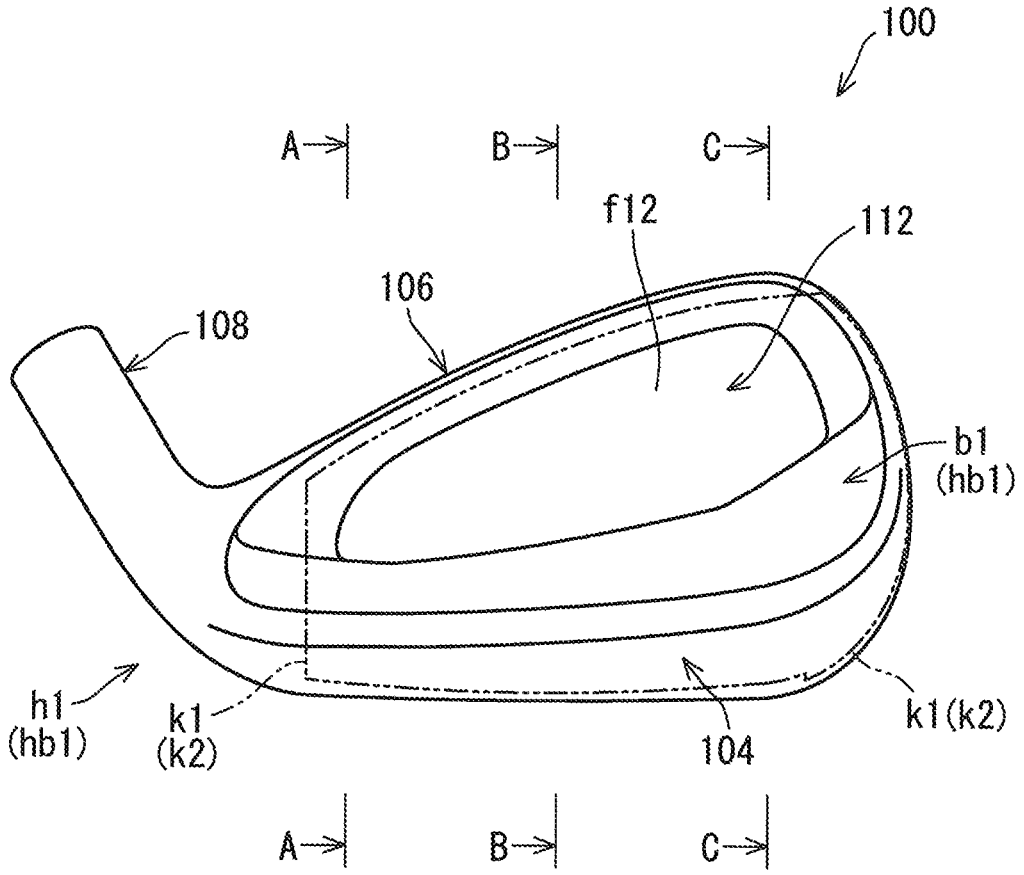
FIG. 2 is a back view of the head in FIG. 1.
Figure 3:
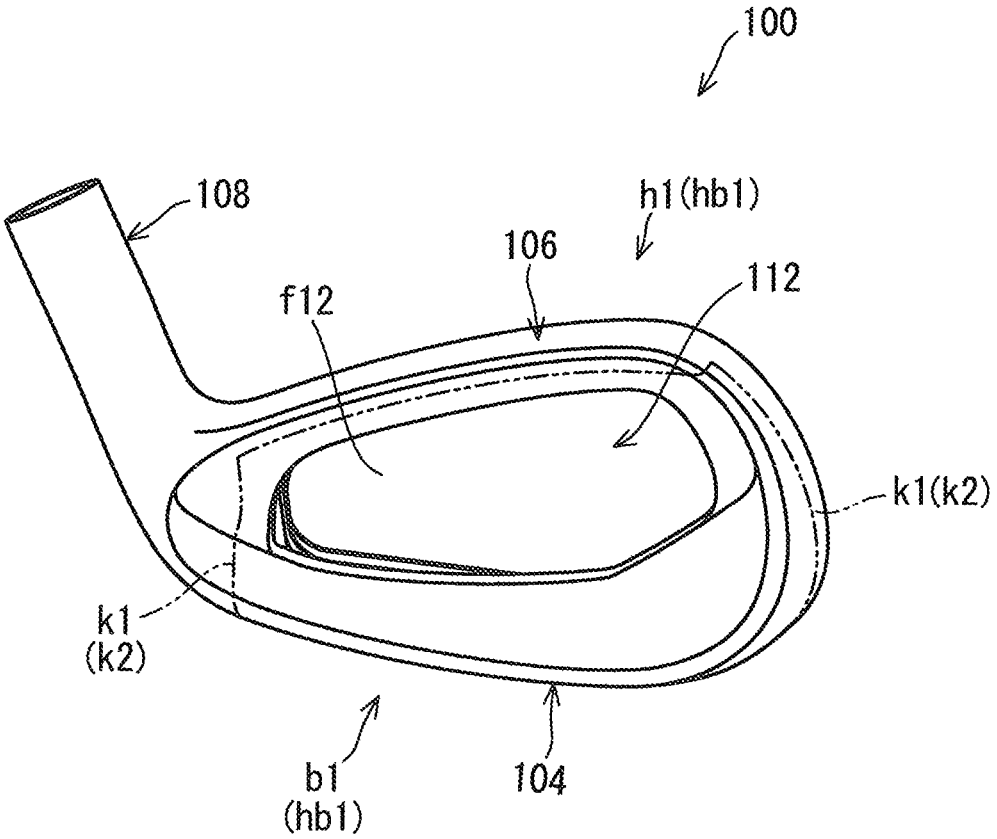
FIG. 3 is a perspective view of the head in FIG. 1.

FIG. 1 is a front view of a head 100 according to a first embodiment. FIG. 2 is a back view of the head 100. FIG. 3 is a perspective view of the head 100.

The head 100 includes the hitting face 102, a sole 104, a top surface 106, and a hosel 108. The hosel 108 includes a hosel hole 110. A shaft (not shown in the drawings) is attached to the hosel hole 110.

The hitting face 102 includes a plurality of face lines gv. The plurality of face lines gv include a longest face line gv1. Of the plurality of face lines gv, only the longest face line gv1 located on the sole-most side is shown in FIG. 1.

The head 100 is an iron-type golf club head. The hitting face 102 is a flat surface. As shown in FIG. 2 and FIG. 3, the head 100 includes a back cavity 112. The head 100 is a cavity back iron.

The head 100 need not necessarily be an iron-type head. The head 100 may be a wood-type head, a utility-type head, or a putter-type head.

Figure 4:
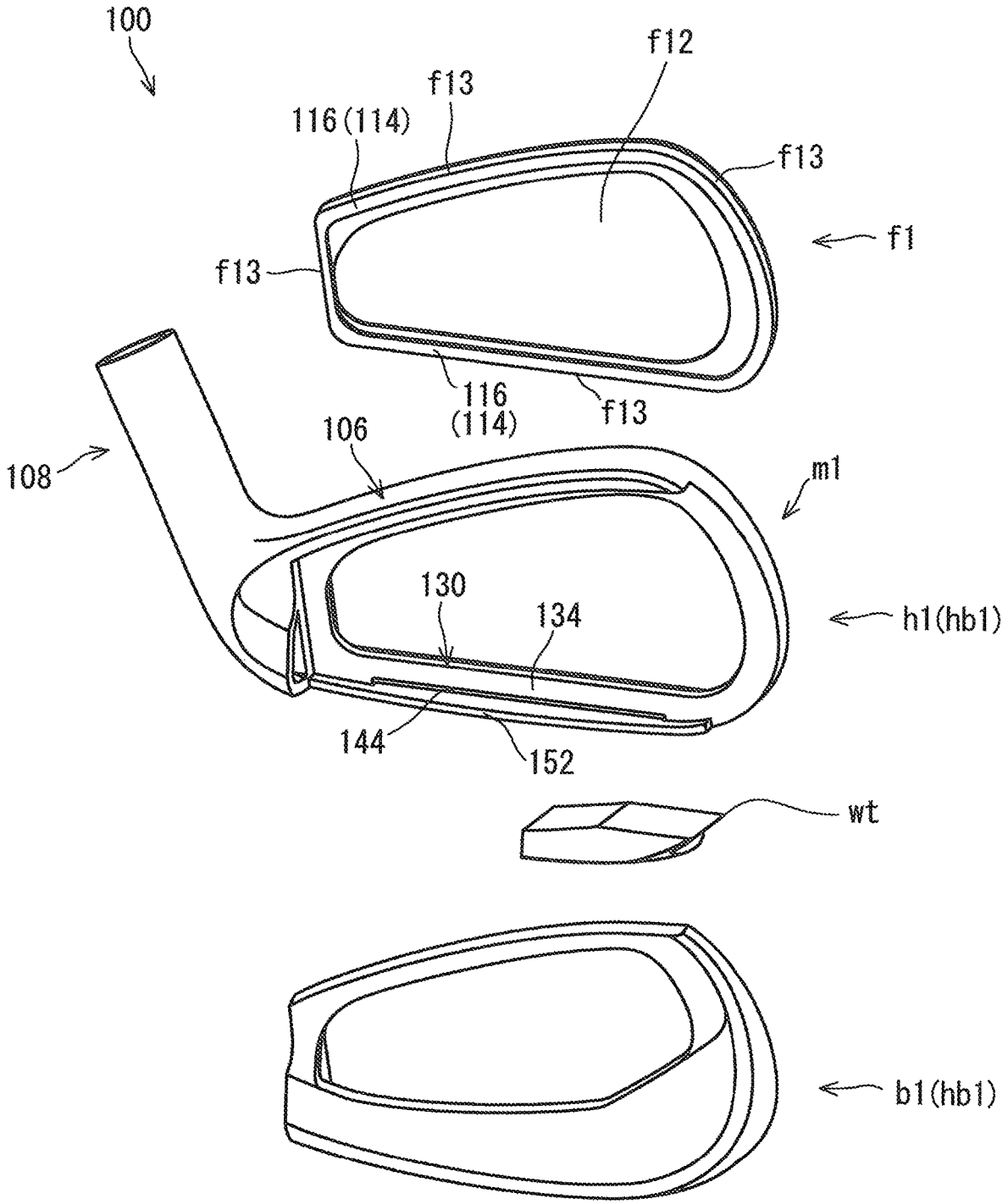
FIG. 4 is an exploded perspective view of the head in FIG. 1.

FIG. 4 is an exploded perspective view of the head 100. The head 100 is formed by a plurality of members. The head 100 includes a head body hb1 and a face plate f1. The face plate f1 is fixed to the head body hb1. The head body hb1 includes a first member h1 and a second member b1. The second member b1 includes a weight wt.

The face plate f1 includes the plate front surface f11, a plate rear surface f12, and a plate side surface f13. As shown in FIG. 1, the plate front surface f11 forms a part of the hitting face 102. The plate front surface f11 forms a large part of the hitting face 102. The plate rear surface f12 is a surface opposite to the plate front surface f11. The plate side surface f13 extends between the outer edge of the plate front surface f11 and the outer edge of the plate rear surface f12.

The plate rear surface f12 includes an outer peripheral edge portion 114. In the present embodiment, the outer peripheral edge portion 114 is formed as a protruding portion. That is, as shown in FIG. 4, the outer peripheral edge portion 114 of the plate rear surface f12 is a peripheral edge protruding portion 116. The peripheral edge protruding portion 116 extends along the outer edge of the plate rear surface f12. The peripheral edge protruding portion 116 is formed over the entire periphery of the plate rear surface f12.

Figure 5:
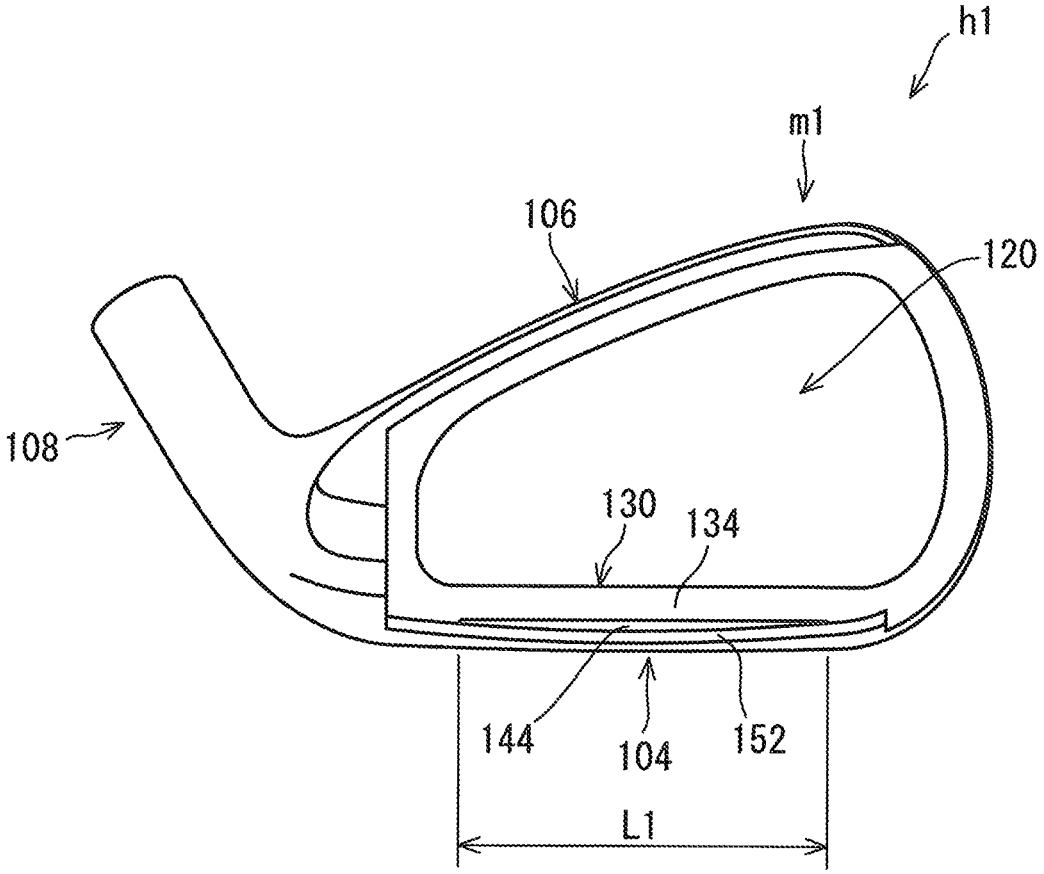
FIG. 5 is a back view of a first member.
Figure 6:
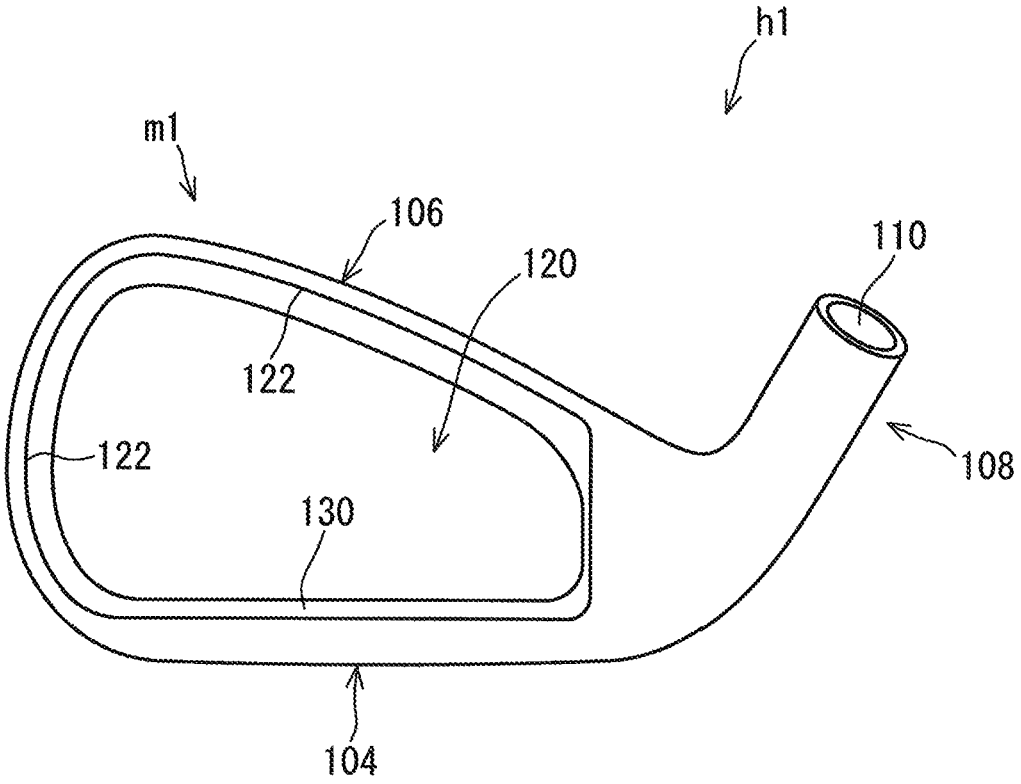
FIG. 6 is a front view of the first member.

FIG. 5 is a back view of the first member h1. FIG. 6 is a front view of the first member h1.

The head body hb1 includes the first member h1 and the second member b1. The head body hb1 is formed by joining the second member b1 to the first member h1. The second member b1 is fixed to the back side of the first member h1. The head body hb1 may be entirely integrally formed as a single-piece member.

The first member h1 includes an opening 120. The opening 120 is a through hole. The opening 120 includes an opening inner surface 122. The face plate f1 is disposed at the opening 120. The face plate f1 is fitted into the opening 120. The opening 120 is covered with the face plate f1. The first member h1 forms a frame body m1 which retains the face plate f1.

The first member h1 forms the entirety of the hosel 108. The first member h1 forms the entirety of the top surface 106. The first member h1 forms a part (front portion) of the sole 104. The first member h1 forms a part (peripheral edge portion) of the hitting face 102.

The second member b1 is attached to the back side of the first member h1. The second member b1 forms a part (rear portion) of the sole 104. The center of gravity of the second member b1 is located on the lower side relative to the center of gravity of the head 100. The center of gravity of the second member b1 is located on the back side relative to the center of gravity of the head 100.

The material of the second member b1 may be the same as the material of the first member h1. The material of the second member b1 may be different from the material of the first member h1. The specific gravity of the second member b1 may be greater than the specific gravity of the first member h1. In this case, the entirety of the second member b1 can be used as a weight body. From the viewpoint of joining strength, the second member b1 is preferably capable of being welded to the first member h1.

A two-dot chain line in FIG. 2 and FIG. 3 indicates a boundary line k1 between the second member b1 and the first member h1. In the head 100 as a completed product which has been subjected to surface finishing, the boundary line k1 is not visually recognized. In the present embodiment, the second member b1 is welded to the first member h1. The boundary line k1 is also a welding position k2. A joining method other than welding may be employed.

The second member b1 includes the weight wt. The center of gravity of the weight wt is located on the toe side relative to the center of gravity of the head 100. The center of gravity of the weight wt is located on the lower side relative to the center of gravity of the head 100. The specific gravity of the weight wt is greater than the specific gravity of the first member h1. The specific gravity of the weight wt is greater than the specific gravity of the second member b1.

Figure 7:
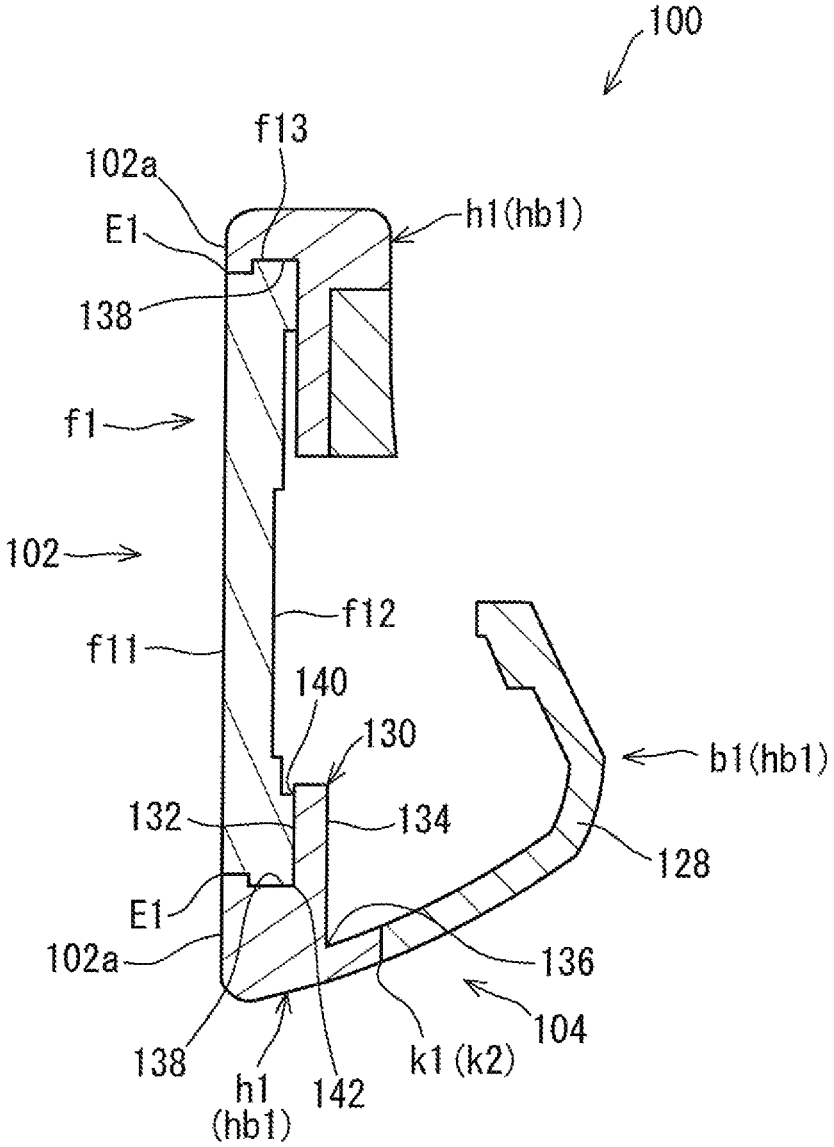
FIG. 7 is a cross-sectional view taken along line A-A in FIG. 2.
Figure 8:
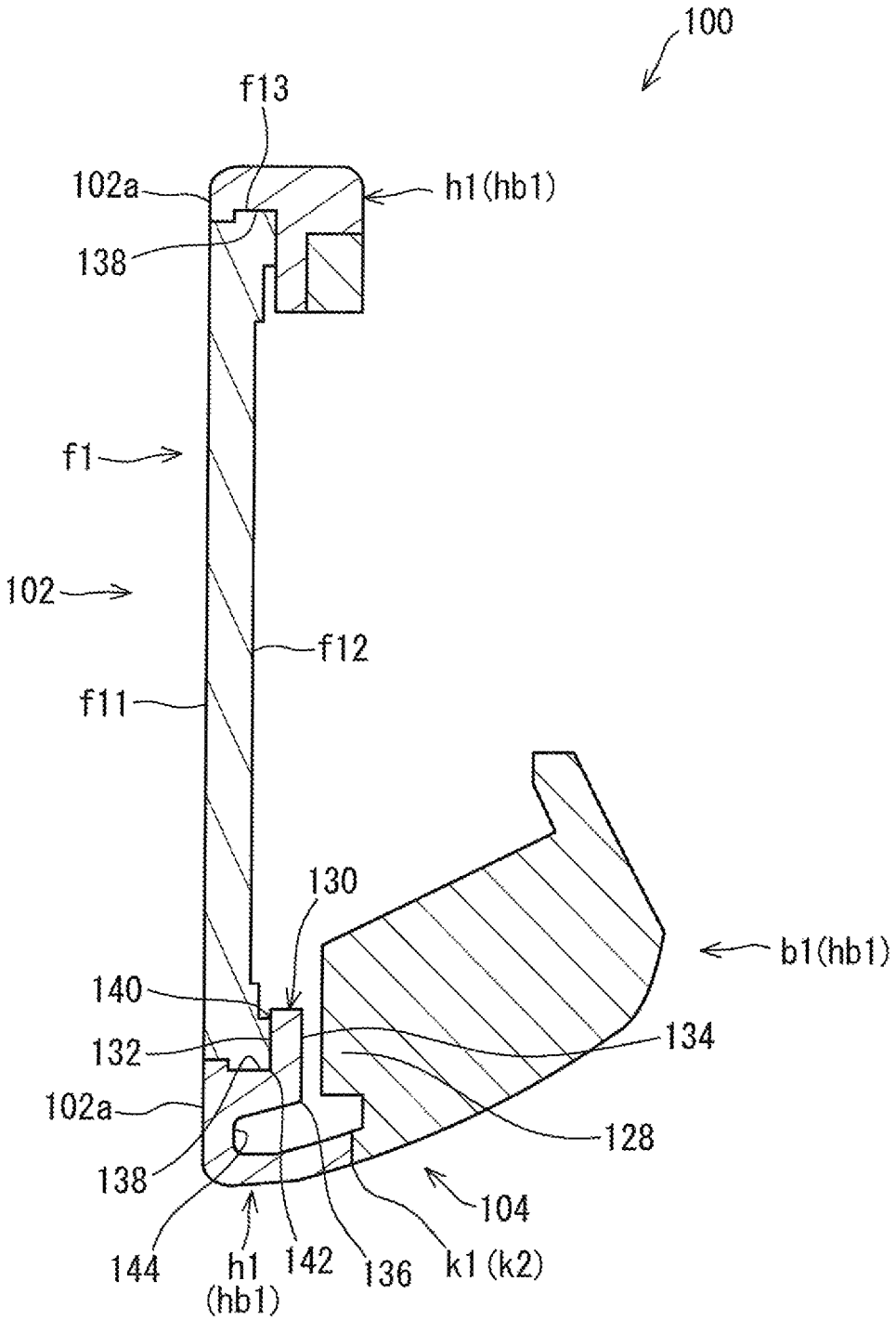
FIG. 8 is a cross-sectional view taken along line B-B in FIG. 2.
Figure 9:
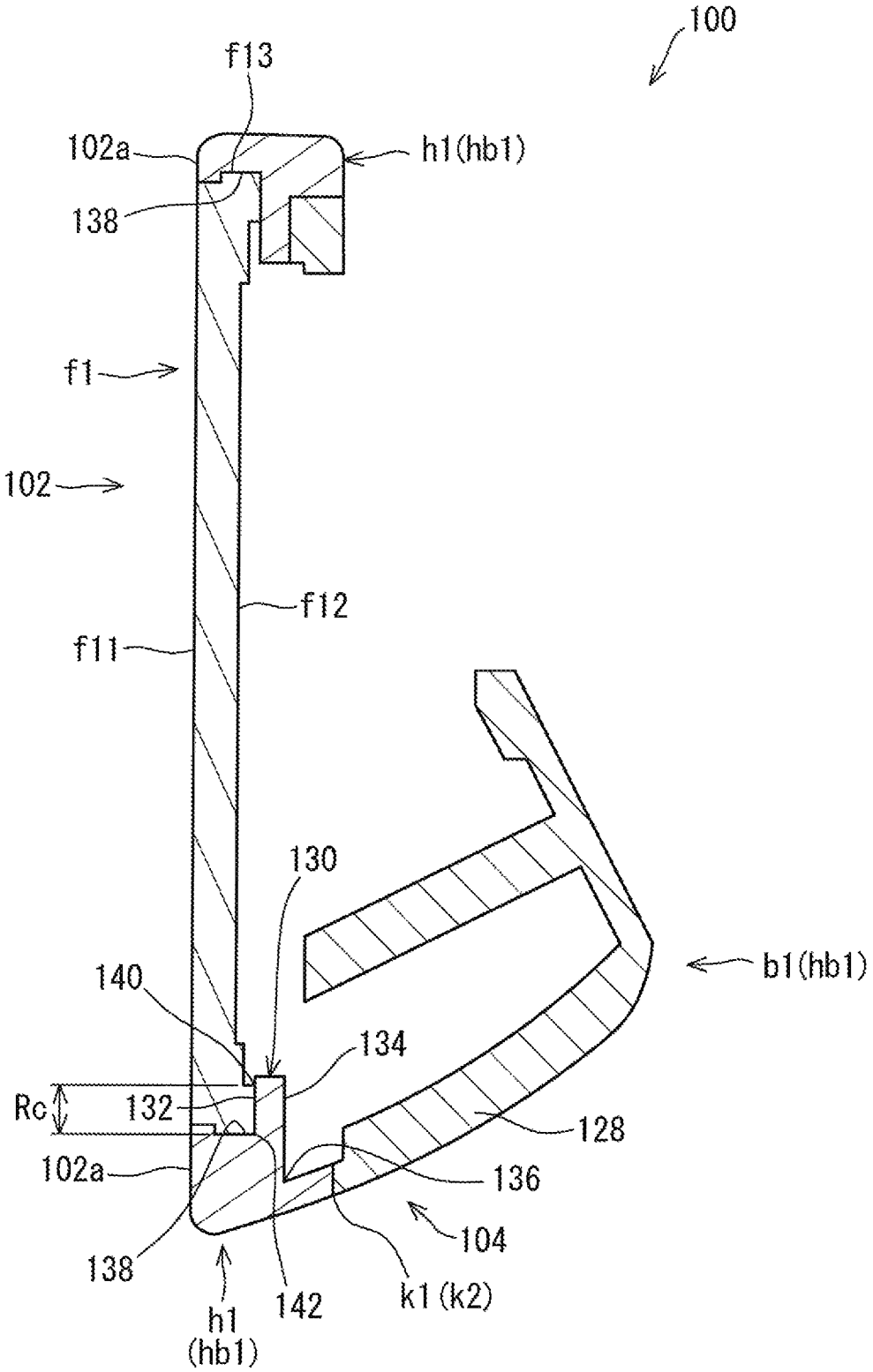
FIG. 9 is a cross-sectional view taken along line C-C in FIG. 2.

FIG. 7 is a cross-sectional view taken along line A-A in FIG. 2. FIG. 8 is a cross-sectional view taken along line B-B in FIG. 2. FIG. 9 is a cross-sectional view taken along line C-C in FIG. 2.

As shown in FIG. 7, FIG. 8, and FIG. 9, the head body hb1 (the first member h1) includes a back support portion 130 which supports the face plate f1 from the back side. The back support portion 130 is provided in the sole-side region of the head body hb1 (the first member h1). The back support portion 130 is a protruding portion (wall) extending from the toe side to the heel side (see FIG. 4 and FIG. 5). The upper end of the back support portion 130 is a free end. The back support portion 130 is spaced from the second member b1.

The back support portion 130 includes a back receiving surface 132. The back receiving surface 132 is the front surface (surface on the face side) of the back support portion 130. The back receiving surface 132 forms an abutting region Rc by abutting on the outer peripheral edge portion 114 of the plate rear surface f12 (see FIG. 9). The back receiving surface 132 is brought into surface-contact with the outer peripheral edge portion 114 (the peripheral edge protruding portion 116) of the plate rear surface f12. In the present embodiment, the back receiving surface 132 is a flat surface.

The back support portion 130 includes a rear surface 134. The rear surface 134 is the back surface of the back support portion 130. The rear surface 134 is a surface opposite to the back receiving surface 132. In the present embodiment, the rear surface 134 is a flat surface.

The rear surface 134 is spaced from the second member b1. The second member b1 includes a rearward disposed portion 128 located on the back side of the rear surface 134. The rearward disposed portion 128 is located on the back side of the back receiving surface 132. The rearward disposed portion 128 is located on the back side of the abutting region Rc. The rearward disposed portion 128 is a part of the head body hb1. When the second member b1 is attached to the first member h1, the rear surface 134 cannot be visually recognized from the back side. When the second member b1 is not attached to the first member h1, the rear surface 134 can be visually recognized from the back side. In a state of the first member h1 being alone, the rear surface 134 can be visually recognized from the back side.

The rear surface 134 includes an end 136 on the face peripheral side. When the back support portion 130 is located in the sole-side region, the face peripheral side means the lower side. The end 136 is the lower end of the rear surface 134.

The first member h1 includes a side receiving surface 138. The side receiving surface 138 abuts on the plate side surface f13.

The abutting region Rc includes an end 140 on the face center side and an end 142 on the face peripheral side. For the back support portion 130 located in the sole-side region, the face center side means the upper side. The end 140 is the upper end of the abutting region Rc. The end 142 is the lower end of the abutting region Rc.

The first member h1 includes a face outer portion 102*a*. The face outer portion 102*a* is a part of the hitting face 102. The face outer portion 102*a* is located on the face peripheral side relative to the plate front surface f11. Of the hitting face 102, a portion located outside the plate front surface f11 is formed by the face outer portion 102*a*. The face outer portion 102*a* forms an outer peripheral portion of the hitting face 102.

As well illustrated in FIG. 8, the first member h1 includes a groove 144. In the present application, the groove 144 is referred to as a body groove. The body groove 144 is recessed toward the face outer portion 102*a*. The body groove 144 is located on the back side of the face outer portion 102*a*.

As shown in FIG. 4 and FIG. 5, the body groove 144 extends from the heel side to the toe side. The body groove 144 extends from a point on the heel side relative to the face center, to a point on the toe side relative to the face center. The body groove 144 extends along the face outer portion 102*a*.

FIG. 8 is a cross-sectional view at a position in the toe-heel direction where the body groove 144 is present. In contrast, FIG. 7 and FIG. 9 are cross-sectional views at respective positions in the toe-heel direction where the body groove 144 is not present. FIG. 7 is a cross-sectional view at a position on the heel side relative to the heel-side end of the body groove 144. FIG. 9 is a cross-sectional view at a position on the toe side relative to the toe-side end of the body groove 144.

As shown in FIG. 7, on the heel side relative to the body groove 144, the lower end 136 of the rear surface 134 is located on the lower side relative to the upper end 140 of the abutting region Rc. On the heel side relative to the body groove 144, the lower end 136 of the rear surface 134 is located on the lower side relative to the lower end 142 of the abutting region Rc. This configuration contributes to reduction in the rigidity of the back support portion 130.

As shown in FIG. 9, on the toe side relative to the body groove 144, the lower end 136 of the rear surface 134 is located on the lower side relative to the upper end 140 of the abutting region Rc. On the toe side relative to the body groove 144, the lower end 136 of the rear surface 134 is located on the lower side relative to the lower end 142 of the abutting region Rc. This configuration contributes to reduction in the rigidity of the back support portion 130.

Figure 10:
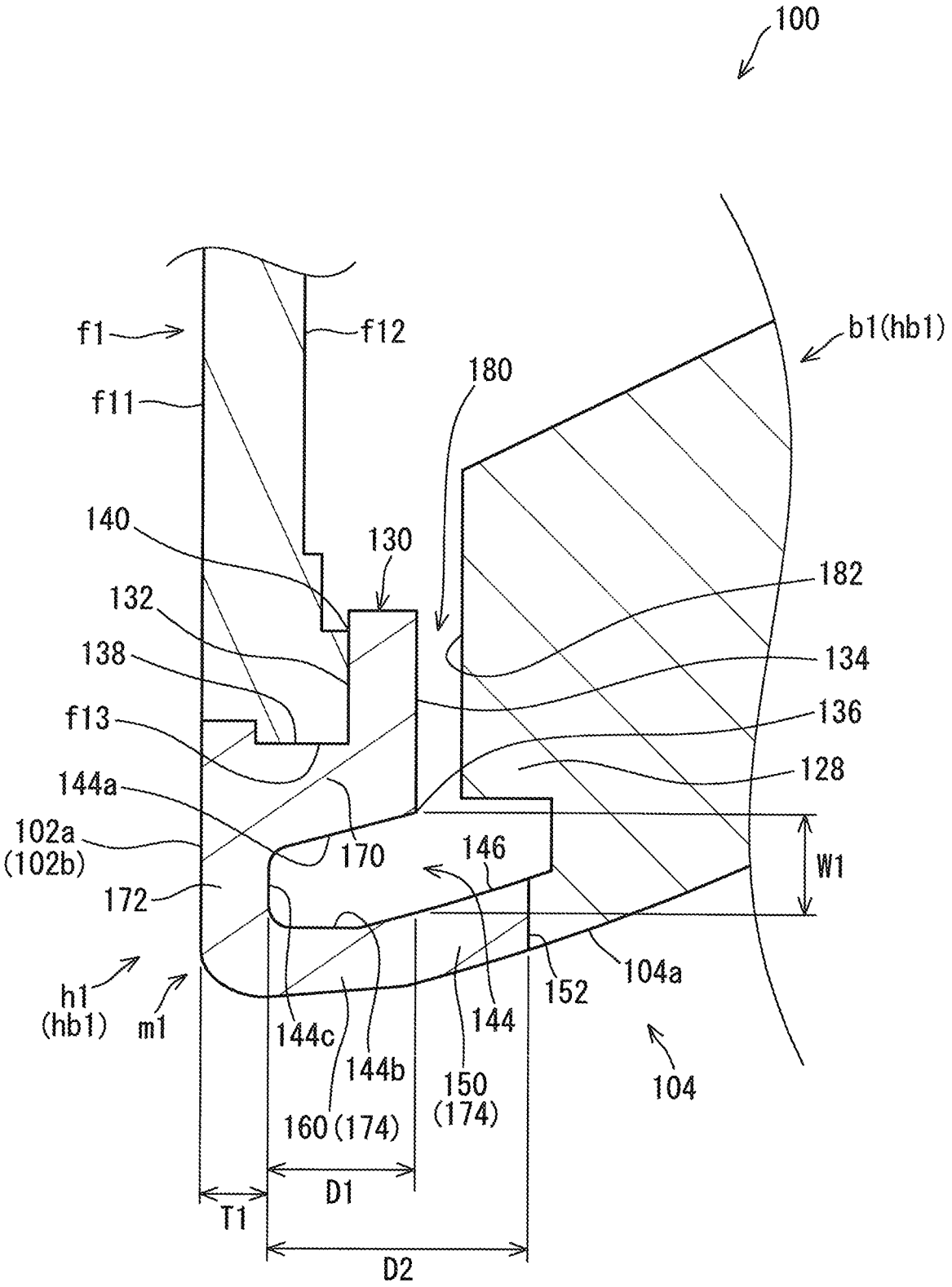
FIG. 10 is an enlarged view of a portion near a body groove in FIG. 8.

FIG. 10 is an enlarged cross-sectional view of a part of FIG. 8.

As described above, the body groove 144 is located on the back side of the face outer portion 102*a*. The face outer portion 102*a* includes a face lower portion 102*b* located on the lower side relative to the face plate f1. In the present embodiment, the body groove 144 is located on the back side of the face lower portion 102*b*.

The body groove 144 is located on the face peripheral side (lower side) relative to the side receiving surface 138. The body groove 144 is located on the face peripheral side (lower side) relative to the plate side surface f13. The body groove 144 is located on the face peripheral side (lower side) relative to the face plate f1. The body groove 144 reduces the thickness of the first member h1 on the face peripheral side relative to the face plate f1. The body groove 144 reduces the rigidity of the first member h1 on the face peripheral side relative to the face plate f1.

The lower end 136 of the rear surface 134 forms an upper edge of the opening of the body groove 144. The end 136 is located on the face peripheral side (lower side) relative to the face plate f1.

The body groove 144 has a depth D1 of greater than the thickness (thickness in the face-back direction) of the back support portion 130 in the abutting region Rc. The body groove 144 is recessed to reach a position located on the face side relative to the back receiving surface 132. The body groove 144 includes a surface 144*a* on the face center side (upper side), a surface 144*b* on the face peripheral side (lower side), and a bottom surface 144*c*. The surface 144*a* has a back-side edge that is the lower end 136 of the rear surface 134. The surface 144*b* on the face peripheral side (lower side) forms the inner surface of the sole 104. The bottom surface 144*c* is located on the face side relative to the back receiving surface 132.

The depth D1 of the body groove 144 may be smaller than the thickness (thickness in the face-back direction) of the back support portion 130 in the abutting region Rc. The bottom surface 144*c* may be located on the back side relative to the back receiving surface 132.

The first member h1 includes an adjacent surface 146 which is adjacent to the surface 144*b*. The adjacent surface 146 is located on the back side of the surface 144*b*. The surface 144*b* and the adjacent surface 146 are the inner surface of the sole 104. The surface 144*b* and the adjacent surface 146 form a continuous surface.

The first member h1 includes an extension portion 150 extending to the back side relative to the rear surface 134. The extension portion 150 includes an outer surface that is a sole surface 104*a*. The sole surface 104*a* is the outer surface of the sole 104. The extension portion 150 includes an inner surface that is the adjacent surface 146. The extension portion 150 includes a rear end surface 152 that is joined to the second member b1.

The first member h1 includes a sole wall portion 160. The sole wall portion 160 forms the surface 144*b* on the face peripheral side (lower side) of the body groove 144. That is, the inner surface of the sole wall portion 160 is the surface 144*b*. The outer surface of the sole wall portion 160 is the sole surface 104*a*.

The first member h1 includes a side wall portion 170. The side wall portion 170 is a portion between the side receiving surface 138 and the surface 144*a*. A part on the back side of the side wall portion 170 is continuous with the back support portion 130.

The first member h1 includes a front wall portion 172. The front wall portion 172 is a portion between the face outer portion 102*a* and the body groove 144 (the bottom surface 144*c*). The front wall portion 172 extends between the side wall portion 170 and the sole wall portion 160.

The extension portion 150 is located on the back side of the sole wall portion 160. The extension portion 150 is continuous with the sole wall portion 160. The extension portion 150 and the sole wall portion 160 form a thin portion 174. The thin portion 174 connects the front wall portion 172 and the second member b1 to each other.

The head 100 includes a slit 180. The slit 180 is a clearance located on the back side of the back support portion 130. The second member b1 includes an opposed surface 182 which is opposed to the rear surface 134. The slit 180 is a clearance between the rear surface 134 and the opposed surface 182. The slit 180 is open toward the face center side. The slit 180 is also open toward the face peripheral side. The slit 180 forms an empty space that is continuous with the internal space of the body groove 144. This space reduces the rigidity of the frame body m1, and enhances the degree of freedom of displacements of the back support portion 130 and its vicinity.

Deformation caused by hitting brings the back support portion 130 closer to the rearward disposed portion 128. When bending of the hitting face 102 is large, the back support portion 130 comes into contact with the rearward disposed portion 128. That is, the bending of the hitting face 102 caused by hitting can bring the back support portion 130 into contact with the rearward disposed portion 128. When the amount of displacement of the back support portion 130 reaches the width in the face-back direction of the slit 180, the back support portion 130 comes into contact with the rearward disposed portion 128. The rearward disposed portion 128 prevents the amount of displacement of the back support portion 130 from becoming a predetermined amount or greater. The rearward disposed portion 128 suppresses reduction in durability due to excessively large bending of the hitting face 102. The rearward disposed portion 128 suppresses the COR to a predetermined value or smaller. The rearward disposed portion 128 prevents an excessively large COR, and inhibits a ball from excessively flying.

The hitting face 102 has a specific measurement point that is a point for measuring a COR, the measurement of the COR at the specific measurement point bringing the back support portion 130 into contact with the rearward disposed portion 128. That is, when the COR is measured at the specific measurement point, the back support portion 130 comes into contact with the rearward disposed portion 128. The specific measurement point is a point on the hitting face 102. The specific measurement point may be the face center. The specific measurement point may be a maximum restitution point of the hitting face 102. The maximum restitution point is a point where the COR becomes maximum. In the head having the specific measurement point, the rearward disposed portion 128 can suppress an excessively large deformation of the hitting face 102, reduction in durability can be suppressed, and an excessively large COR can be prevented.

Preferably, in the measurement of the COR at the maximum restitution point, the back support portion 130 comes into contact with the rearward disposed portion 128. This contact enables the COR at the maximum restitution point to be effectively suppressed, and thus the durability can be improved. The COR at the maximum restitution point is preferably less than or equal to 0.836. The COR at the specific measurement point is preferably less than or equal to 0.836. A method for measuring the COR will be described later. Preferably, the COR at the maximum restitution point is less than or equal to the COR of a baseline plate specified in the measurement method described later.

Figure 11:
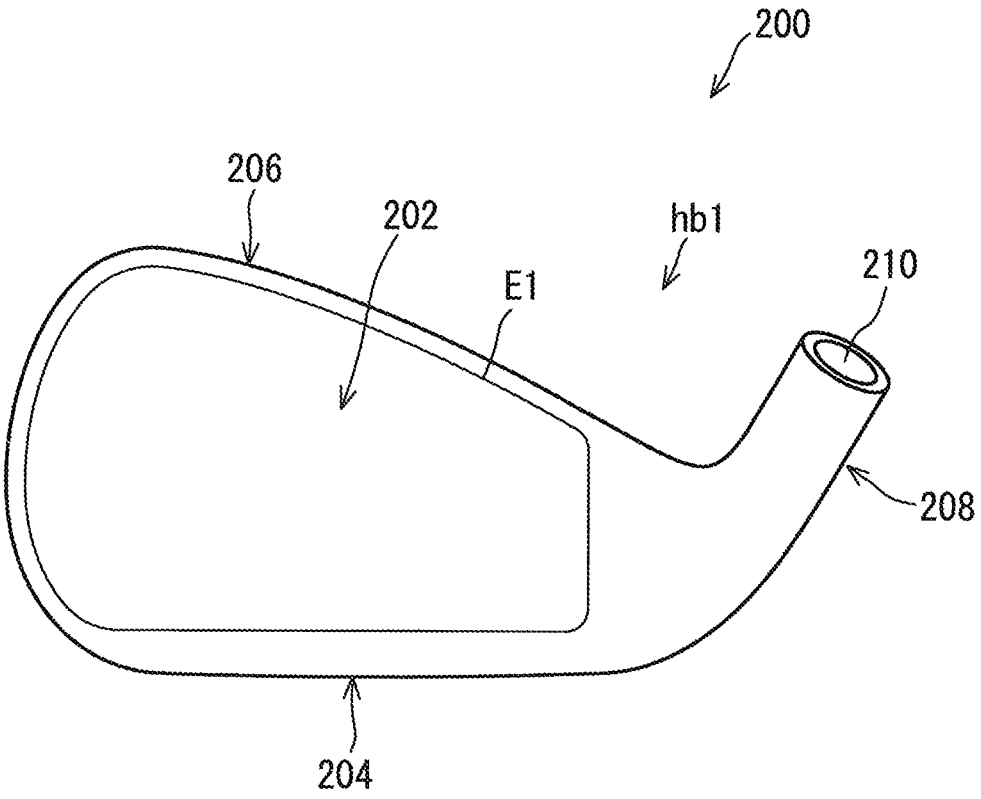
FIG. 11 is a front view of a golf club head according to a second embodiment.
Figure 12:
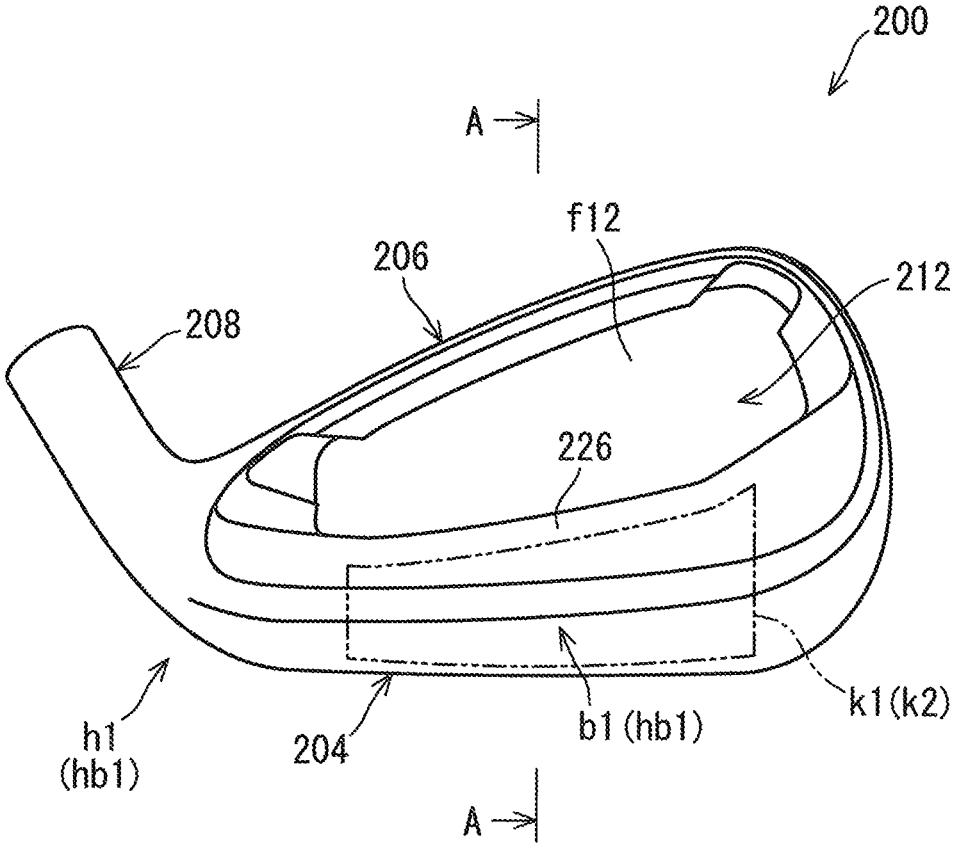
FIG. 12 is a back view of the head in FIG. 11.
Figure 13:
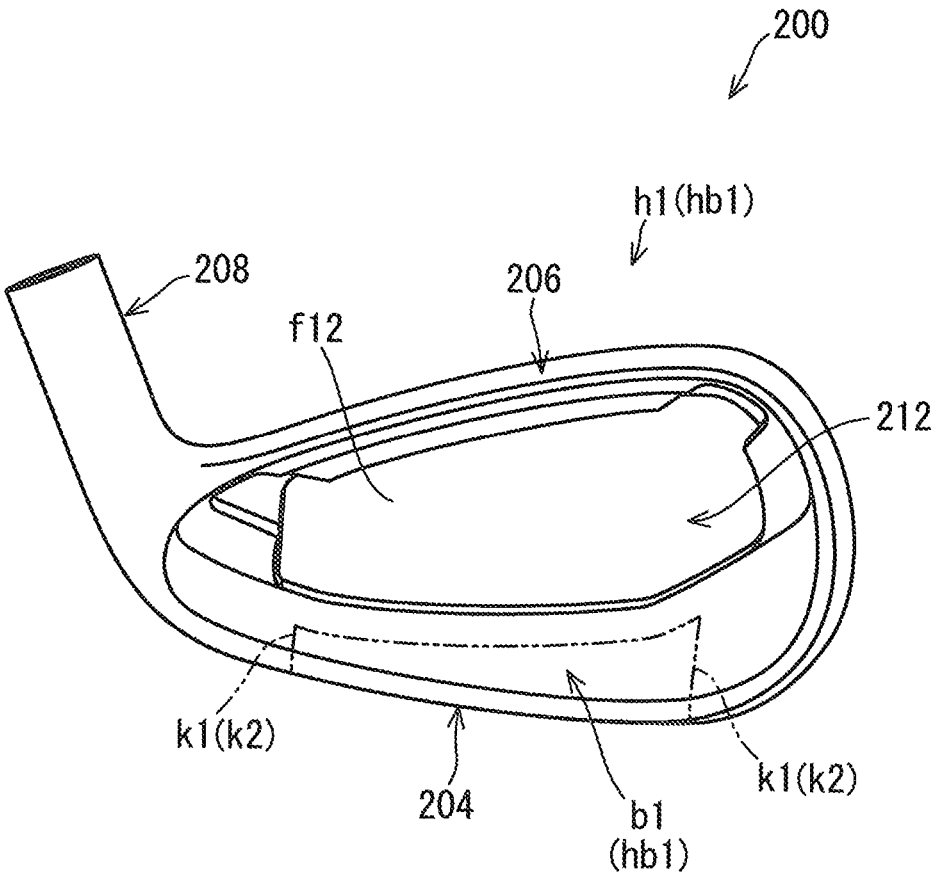
FIG. 13 is a perspective view of the head in FIG. 11.

FIG. 11 is a front view of a head 200 according to a second embodiment. FIG. 12 is a back view of the head 200. FIG. 13 is a perspective view of the head 200.

The head 200 includes a hitting face 202, a sole 204, a top surface 206, and a hosel 208. The hosel 208 includes a hosel hole 210. A shaft (not shown in the drawings) is attached to the hosel hole 210. The hitting face 202 is provided with a plurality of face lines, but FIG. 11 does not show the face lines.

The head 200 is an iron-type golf club head. The hitting face 202 is a flat surface. As shown in FIG. 12 and FIG. 13, the head 200 includes a back cavity 212. The head 200 is a cavity back iron.

Figure 14:
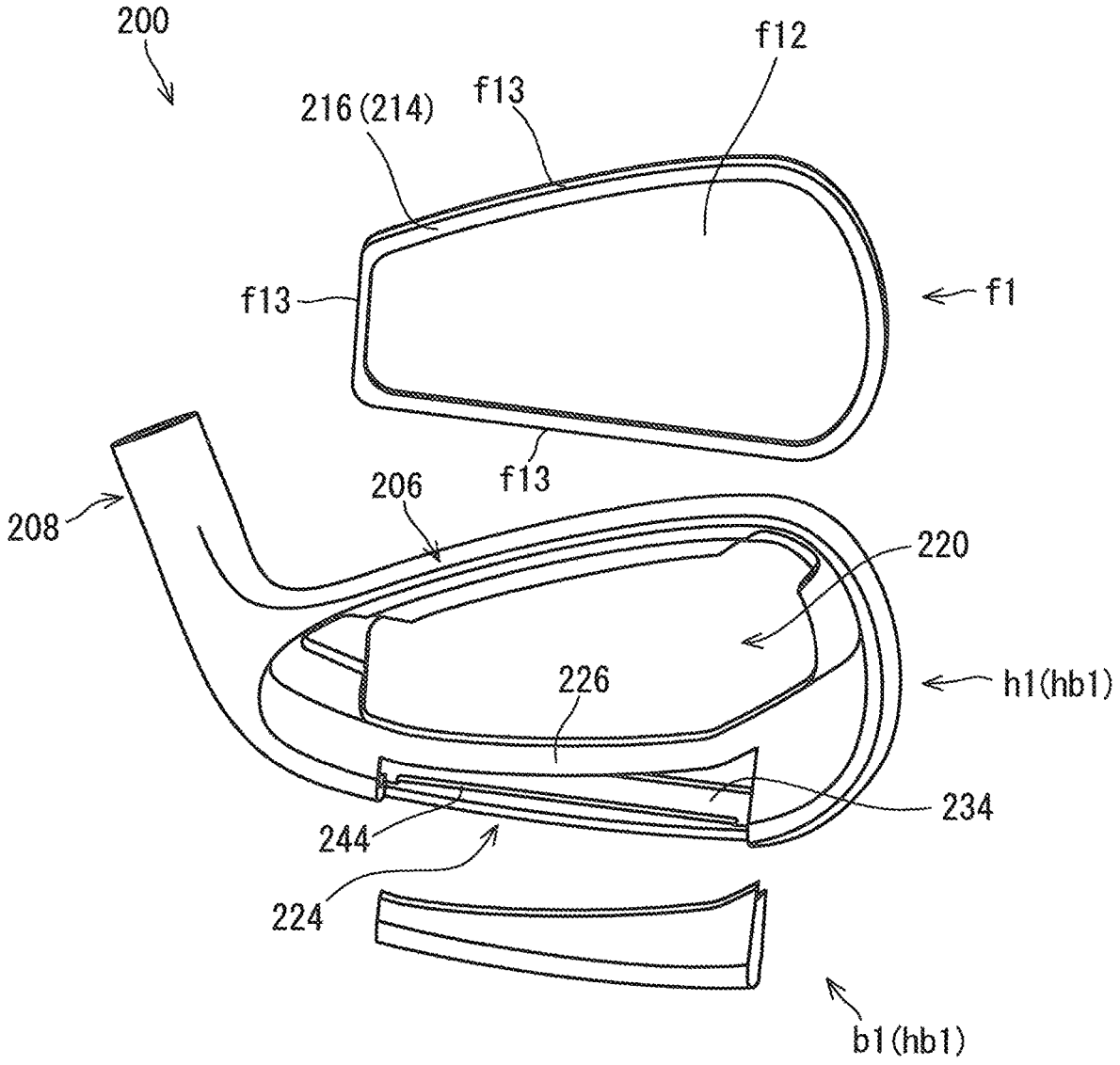
FIG. 14 is an exploded perspective view of the head in FIG. 11.

FIG. 14 is an exploded perspective view of the head 200. The head 200 is formed by a plurality of members. The head 200 includes a head body hb1 and a face plate f1. The head body hb1 includes a first member h1 and a second member b1.

The face plate f1 includes a plate front surface f11, a plate rear surface f12, and a plate side surface f13. As shown in FIG. 11, the plate front surface f11 forms a part of the hitting face 202. The plate front surface f11 forms a large part of the hitting face 202. The plate rear surface f12 is a surface opposite to the plate front surface f11. The plate side surface f13 extends between the outer edge of the plate front surface f11 and the outer edge of the plate rear surface f12.

The plate rear surface f12 includes an outer peripheral edge portion 214. In the present embodiment, the outer peripheral edge portion 214 is formed as a protruding portion. That is, as shown in FIG. 14, the outer peripheral edge portion 214 of the plate rear surface f12 is a peripheral edge protruding portion 216. The peripheral edge protruding portion 216 extends along the outer edge of the plate rear surface f12. The peripheral edge protruding portion 216 is formed over the entire periphery of the plate rear surface f12.

Figure 15:
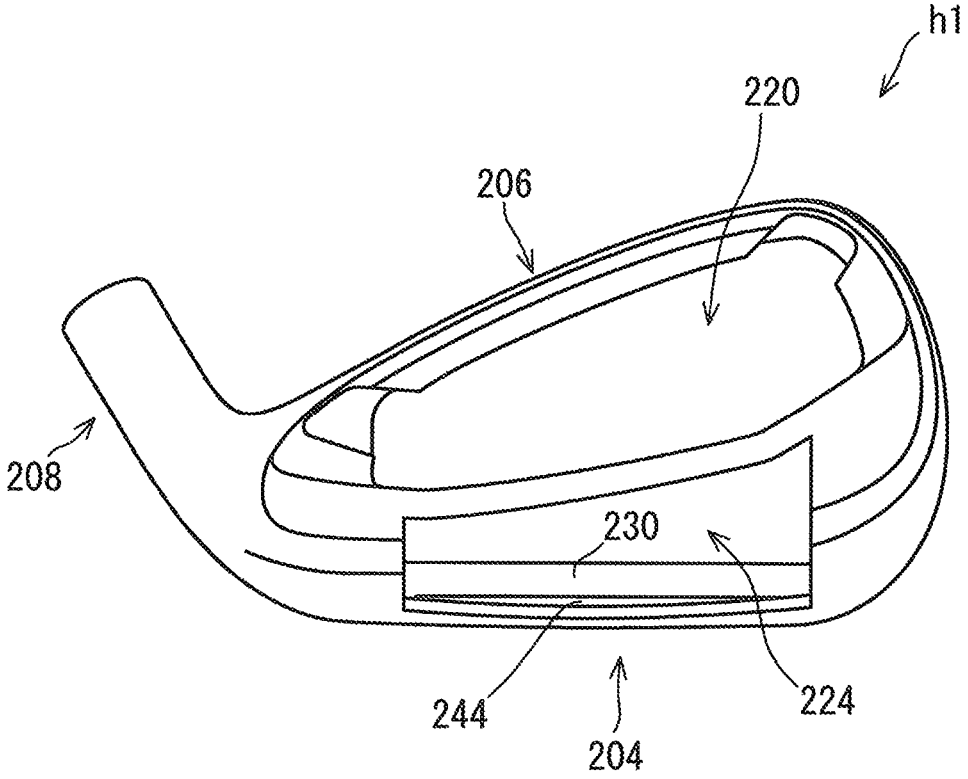
FIG. 15 is a back view of a first member.
Figure 16:
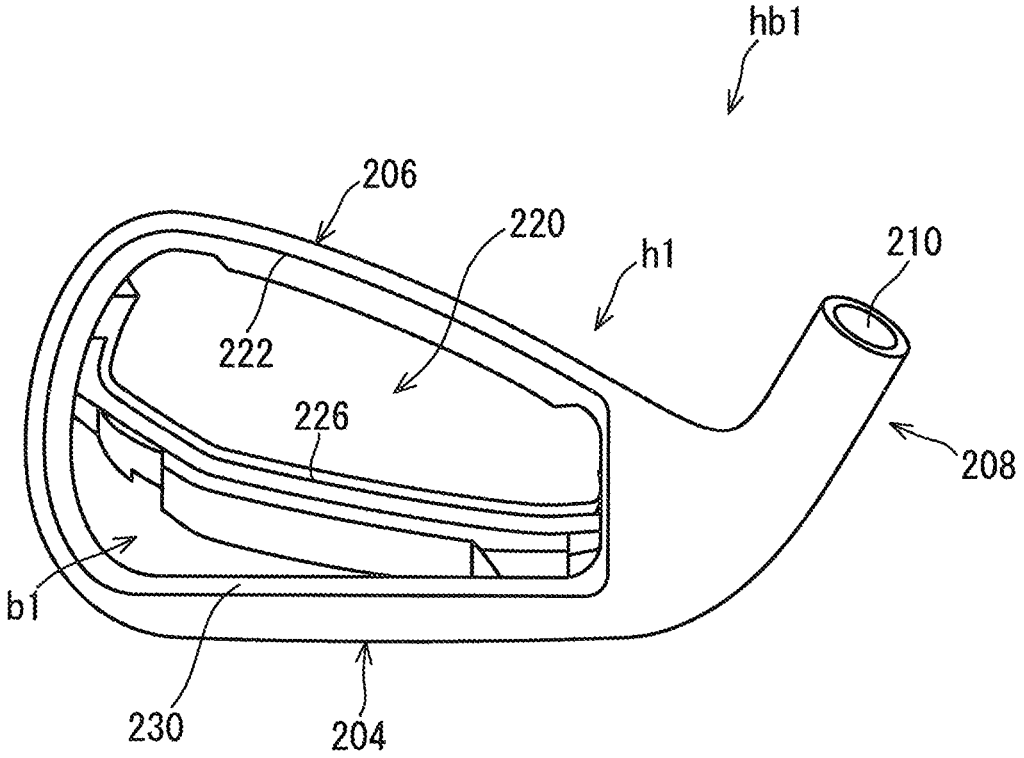
FIG. 16 is a front view of a head body.

FIG. 15 is a back view of the first member h1. FIG. 16 is a front view of the head body hb1.

The first member h1 includes an opening 220. The opening 220 is a through hole. The face plate f1 is disposed at the opening 220. The face plate f1 is fitted into the opening 220. The opening 220 is covered with the face plate f1. The first member h1 forms a frame body m1 which retains the face plate f1. The opening 220 is also referred to as a first opening.

As well indicated in FIG. 15, the first member h1 includes a second opening 224. The second opening 224 is a through hole. The second opening 224 is formed to extend from the sole 204 to the back face. The second member b1 is attached to the second opening 224. The second opening 224 is covered with the second member b1.

The first member h1 includes a bridge portion 226. On the back side of the first member h1, the bridge portion 226 connects the toe side and the heel side to each other.

The second member b1 is attached to the back side of the first member h1. The second member b1 forms a part (rear portion) of the sole 204. The center of gravity of the second member b1 is located on the lower side relative to the center of gravity of the head 200. The center of gravity of the second member b1 is located on the back side relative to the center of gravity of the head 200.

A two-dot chain line in FIG. 12 and FIG. 13 indicates a boundary line k1 between the second member b1 and the first member h1. In the head 200 as a completed product which has been subjected to surface finishing, the boundary line k1 is not visually recognized. In the present embodiment, the second member b1 is welded to the first member h1. The boundary line k1 is also a welding position k2. A joining method other than welding may be employed.

Figure 17:
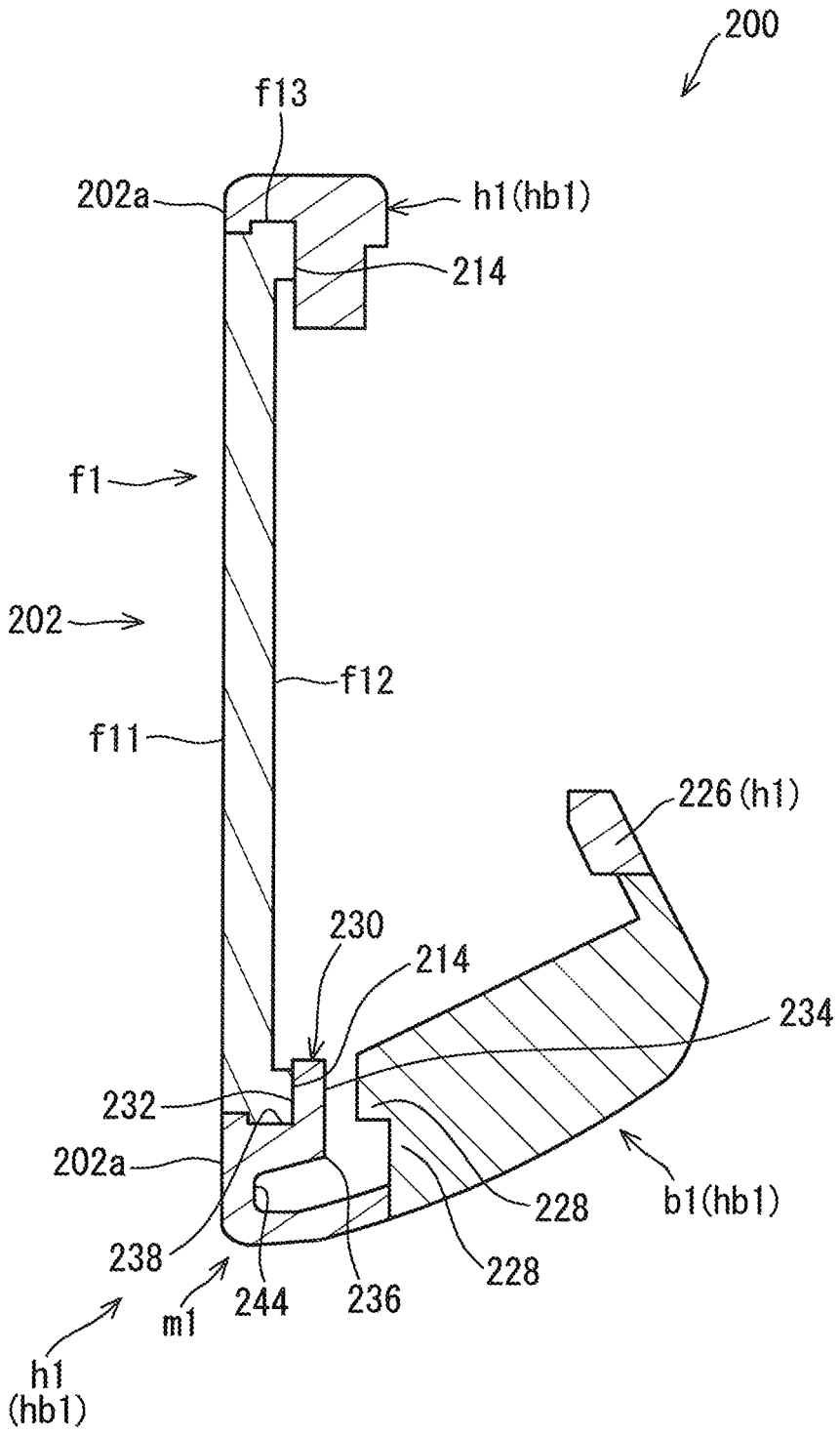
FIG. 17 is a cross-sectional view taken along line A-A in FIG. 12.

FIG. 17 is a cross-sectional view taken along line A-A in FIG. 12. The first member h1 includes a back support portion 230 which supports the face plate f1 from the back side. The back support portion 230 is provided in the sole-side region of the first member h1. The back support portion 230 is a protruding portion (wall) extending from the toe side to the heel side (see FIG. 15 and FIG. 16). The upper end of the back support portion 230 is a free end. The back support portion 230 is spaced from the second member b1.

The back support portion 230 includes a back receiving surface 232. The back receiving surface 232 is the front surface (surface on the face side) of the back support portion 230. The back receiving surface 232 abuts on the outer peripheral edge portion 214 of the plate rear surface f12.

The back support portion 230 includes a rear surface 234. The rear surface 234 is the back surface of the back support portion 230. The rear surface 234 is a surface opposite to the back receiving surface 232. In the present embodiment, the rear surface 234 is a flat surface.

The rear surface 234 is spaced from the second member b1. The second member b1 includes a rearward disposed portion 228 located on the back side of the rear surface 234. When the second member b1 is attached to the first member h1, the rear surface 234 cannot be visually recognized from the back side. When the second member b1 is not attached to the first member h1, the rear surface 234 can be visually recognized from the back side. In a state of the first member h1 being alone, the rear surface 234 can be visually recognized from the back side.

The rear surface 234 includes an end 236 on the face peripheral side. When the back support portion 230 is located in the sole-side region, the face peripheral side means the lower side. The end 236 is the lower end of the rear surface 234.

The first member h1 includes a side receiving surface 238. The side receiving surface 238 abuts on the plate side surface f13.

The first member h1 includes a face outer portion 202*a*. The face outer portion 202*a* is a part of the hitting face 202. The face outer portion 202*a* is located on the face peripheral side relative to the plate front surface f11.

As well illustrated in FIG. 14, the first member h1 includes a body groove 244. The body groove 244 is recessed toward the face outer portion 202*a*. The body groove 244 is located on the back side of the face outer portion 202*a*. The body groove 244 extends from the heel side to the toe side. The body groove 244 reduces the rigidity of the frame body m1 which retains the face plate f1.

Also in the second embodiment, the structures of the body groove 244 and its vicinity are the same as those in the first embodiment.

Figure 18:
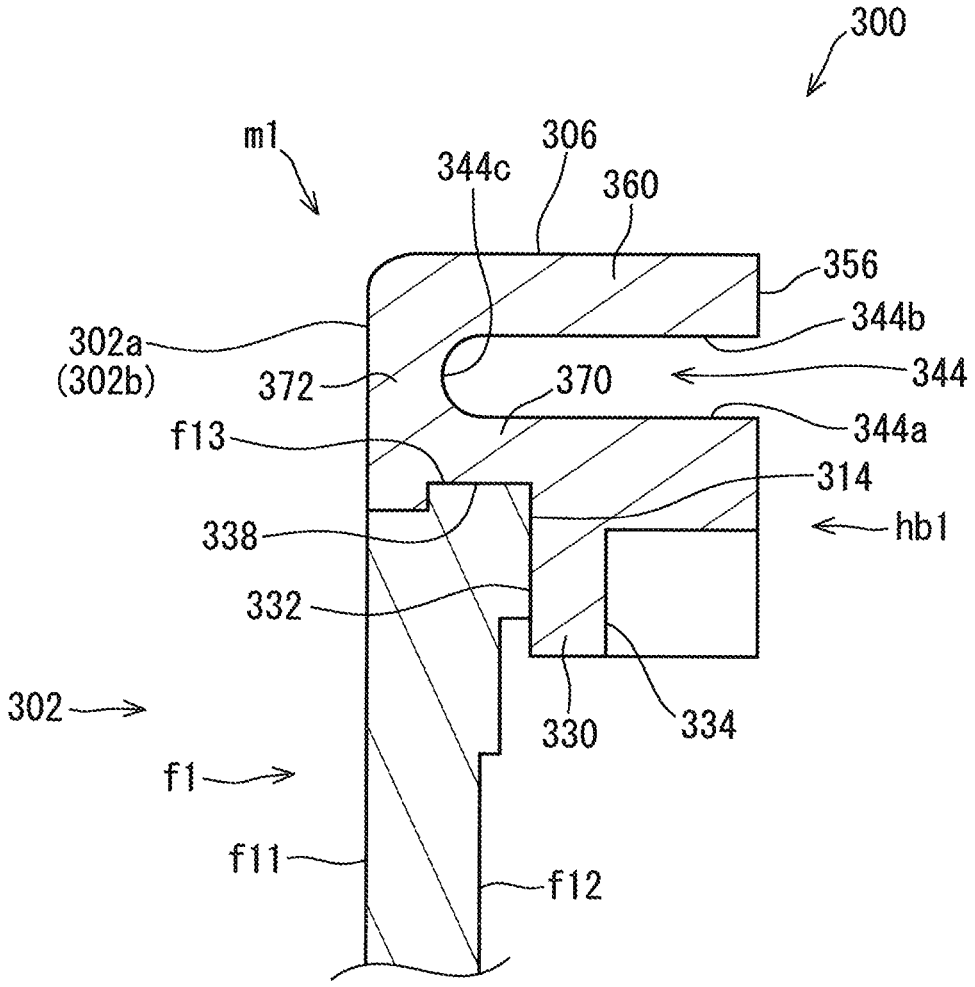
FIG. 18 is an enlarged cross-sectional view showing a top portion of a golf club head according to a third embodiment.

FIG. 18 is a cross-sectional view showing a portion on the top side of a head 300 according to a third embodiment. Similar to the head 100 described above, the head 300 includes a head body hb1 and a face plate f1. The head body hb1 forms a top surface 306. The face plate f1 includes a plate front surface f11, a plate rear surface f12, and a plate side surface f13. The plate front surface f11 forms a hitting face 302.

The head body hb1 of the head 300 includes a back support portion 330 which supports the face plate f1 from the back side. The back support portion 330 is provided in the top-side region of the head body hb1. The back support portion 330 is a protruding portion (wall) extending from the toe side to the heel side. The back support portion 330 protrudes toward the lower side.

The back support portion 330 includes a back receiving surface 332. The back receiving surface 332 is the front surface (surface on the face side) of the back support portion 330. The back receiving surface 332 forms an abutting region Rc by abutting on an outer peripheral edge portion 314 of the plate rear surface f12. The back receiving surface 332 is brought into surface-contact with the outer peripheral edge portion 314 of the plate rear surface f12.

The back support portion 330 includes a rear surface 334. The rear surface 334 is the back surface of the back support portion 330. The rear surface 334 is a surface opposite to the back receiving surface 332.

The head body hb1 includes a side receiving surface 338. The side receiving surface 338 abuts on the plate side surface f13. The head body hb1 forms a frame body m1 which retains the face plate f1.

The head body hb1 includes a face outer portion 302*a*. The face outer portion 302*a* is a part of the hitting face 302. The face outer portion 302*a* is located on the face peripheral side relative to the plate front surface f11. Of the hitting face 302, a portion located outside the plate front surface f11 is formed by the face outer portion 302*a*. The face outer portion 302*a* forms an outer peripheral portion of the hitting face 302.

The head body hb1 includes a body groove 344. The body groove 344 is recessed toward the face outer portion 302*a*. The body groove 344 is located on the back side of the face outer portion 302*a*. Although not shown in the drawings, the body groove 344 extends from the heel side to the toe side. The body groove 344 extends from a point on the heel side relative to the face center, to a point on the toe side relative to the face center.

The body groove 344 is located on the back side of the face outer portion 302*a*. The face outer portion 302*a* includes a face upper portion 302*b* located on the upper side relative to the face plate f1. In the present embodiment, the body groove 344 is located on the back side of the face upper portion 302*b*.

The body groove 344 is located on the face peripheral side (upper side) relative to the side receiving surface 338. The body groove 344 is located on the face peripheral side (upper side) relative to the plate side surface f13.

The body groove 344 is located on the face peripheral side (upper side) relative to the face plate f1. The body groove 344 reduces the thickness of the head body hb1 on the face peripheral side relative to the face plate f1. The body groove 344 reduces the rigidity of the head body hb1 on the face peripheral side relative to the face plate f1. The body groove 344 reduces the rigidity of the frame body m1 which retains the face plate f1.

The head body hb1 includes a back surface 356 forming the back face of the head 300. The body groove 344 is recessed from the back surface 356 toward the face outer portion 302*a*. The body groove 344 has an opening that is formed on the back surface 356. The body groove 344 is open toward the back side. The body groove 344 is recessed to reach a position located on the face side relative to the back receiving surface 332. The body groove 344 includes a surface 344*a* on the face center side (lower side), a surface 344*b* on the face peripheral side (upper side), and a bottom surface 344*c*. The body groove 344 forms an empty space on the face peripheral side (upper side) of the back support portion 330.

The head body hb1 includes a top wall portion 360. The top wall portion 360 forms the surface 344*b* on the face peripheral side (upper side) of the body groove 344. That is, the inner surface of the top wall portion 360 is the surface 344*b*. The outer surface of the top wall portion 360 is the top surface 306.

The head body hb1 includes a side wall portion 370. The side wall portion 370 is a portion between the side receiving surface 338 and the surface 344*a*.

The head body hb1 includes a front wall portion 372. The front wall portion 372 is a portion between the face outer portion 302*a* and the body groove 344. The front wall portion 372 extends between the side wall portion 370 and the top wall portion 360.

The head 100, the head 200, and the head 300 described above satisfy the following configuration X.

[Configuration X]: A head body includes a face outer portion that is a part of a hitting face and that is located on the face peripheral side relative to a plate front surface, and a body groove that is located on the back side of the face outer portion and that is recessed toward the face outer portion.

Examples of the configuration X include a configuration X1, a configuration X2, a configuration X3, and a configuration X4 as shown below.

[Configuration X1]: The sole-side region of a head body includes a face lower portion that is a part of a hitting face and that is located on the lower side relative to a plate front surface, and a body groove that is located on the back side of the face lower portion and that is recessed toward the face lower portion.

[Configuration X2]: The top-side region of a head body includes a face upper portion that is a part of a hitting face and that is located on the upper side relative to a plate front surface, and a body groove that is located on the back side of the face upper portion and that is recessed toward the face upper portion.

[Configuration X3]: The toe-side region of a head body includes a face toe portion that is a part of a hitting face and that is located on the toe side relative to a plate front surface, and a body groove that is located on the back side of the face toe portion and that is recessed toward the face toe portion.

[Configuration X4]: The heel-side region of a head body includes a face heel portion that is a part of a hitting face and that is located on the heel side relative to a plate front surface, and a body groove that is located on the back side of the face heel portion and that is recessed toward the face heel portion.

The head 100 of the first embodiment and the head 200 of the second embodiment are examples of heads that satisfy the configuration X1. The head 300 of the third embodiment is an example of a head that satisfies the configuration X2.

Bending deformation toward the back side occurs in the face plate f1 at impact. However, unless the head body hb1 deforms, this bending deformation occurs only in the face plate f1, and thus, the deformed region is small. The configuration X reduces the rigidity of the frame body m1 which supports the peripheral edge portion of the face plate f1, thereby deforming the frame body m1. In the embodiment of FIG. 10, a deformation starting from the vicinity of the front wall portion 172 occurs. Since the head body hb1 around the face plate f1 also deforms, the scope of the bending deformation of the hitting face is expanded to the face peripheral side, and the amount of the bending deformation is increased. As a result, the rebound performance on the face peripheral side is improved, and variation in the coefficient of restitution due to variation in hitting points is suppressed. In addition, since the scope of the bending deformation is expanded, the rebound performance of the entirety of the hitting face is enhanced.

The configuration X particularly enhances the rebound performance in the vicinity of a region in which the configuration X is located. The configuration X1 particularly enhances the rebound performance on the lower side of the hitting face. The configuration X2 particularly enhances the rebound performance on the upper side of the hitting face. The configuration X3 particularly enhances the rebound performance on the toe side of the hitting face. The configuration X4 particularly enhances the rebound performance on the heel side of the hitting face.

The head including the configuration X has at least one configuration selected from the group consisting of the configuration X1, the configuration X2, the configuration X3, and the configuration X4. The head may have two or more configurations selected from the group consisting of the configuration X1, the configuration X2, the configuration X3, and the configuration X4. The head may have three or more configurations selected from the group consisting of the configuration X1, the configuration X2, the configuration X3, and the configuration X4. The head may have the configuration X1, the configuration X2, the configuration X3, and the configuration X4. The head may have the configuration X1 and the configuration X2. The head may have the configuration X3 and the configuration X4.

The back support portion 130 need not necessarily be formed to surround the entire periphery of the opening 120. The back support portion 130 may have a gap so that the back support portion 130 partially surround the opening 120. For example, the gap in which the back support portion 130 is not formed may be present in the sole-side region. A through hole that penetrates the sole 4 may be provided in the gap in which the back support portion 130 is not formed, for example.

The center portion of the face plate f1 is more likely to deform than the peripheral portion of the face plate f1. The rebound performance of the peripheral portion tends to be lower than the rebound performance of the center portion. In contrast, the configuration X increases the deformation of the frame body m1 which supports the face plate f1, and thus, enhances the rebound performance of the peripheral portion of the hitting face. As a result, the difference in the coefficient of restitution between the peripheral portion and the center portion of the hitting face can be reduced.

Figure 19:
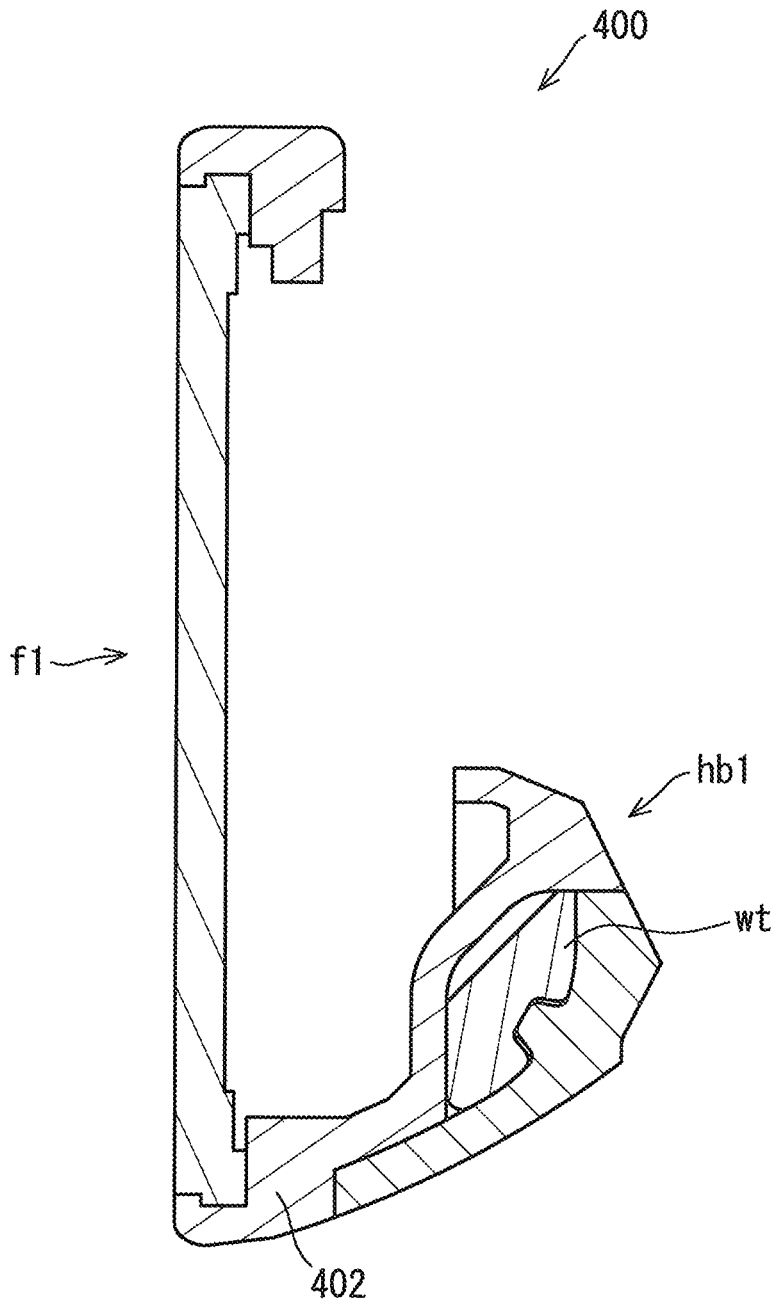
FIG. 19 is a cross-sectional view of a golf club head of Comparative Example.

FIG. 19 is a cross-sectional view of a head 400 of Comparative Example. In the head 400, a face plate f1 is attached to an opening of a head body hb1. In the head 400, the rigidity of a back support portion 402 in the sole-side region is high. Therefore, deformation at impact substantially occurs only in the face plate f1, and a portion outside the face plate f1 scarcely deforms. As a result, the deformed region of the hitting face is small and the coefficient of restitution on the lower side of the hitting face is low. In contrast, in the case of the head 100 and the head 200 having the configuration X1, the deformed region of the hitting face is expanded to the lower side relative to the face plate f1, and thus the coefficient of restitution on the lower side of the hitting face is increased.

Particularly in an iron-type golf club head, the hitting point tends to be located on the lower side (sole side). Since the configuration X1 can enhance the rebound performance when the hitting point is located on the lower side, the configuration X1 effectively enhances the rebound performance of the iron-type golf club head.

As shown in FIG. 10, the body groove 144 reduces the thickness of the front wall portion 172, and reduces the rigidity of this portion. As described above, the thin front wall portion 172 can be a starting point of deformation of the head body hb1. When the front wall portion 172 serves as the starting point of deformation, the bending scope of the hitting face 102 is expanded to the face peripheral side. From the viewpoint of expanding the bending scope of the hitting face 102 to enhance the rebound performance, the front wall portions 172 and 372 have a thickness T1 of preferably less than or equal to 4 mm, more preferably less than or equal to 3 mm, and still more preferably less than or equal to 2.5 mm. From the viewpoint of strength, the thickness T1 of the front wall portions 172 and 372 is preferably greater than or equal to 0.5 mm, and more preferably greater than or equal to 1 mm. The thickness T1 of the front wall portion is measured along the face-back direction.

From the viewpoint of reducing the rigidity of the frame body m1 of the head body hb1 and facilitating bending of the hitting face 102, the side wall portions 170 and 370 have a thickness of preferably less than or equal to 4 mm, more preferably less than or equal to 3 mm, and still more preferably less than or equal to 2.5 mm. From the viewpoint of strength, the thickness of the side wall portions 170 and 370 is preferably greater than or equal to 0.5 mm, and more preferably greater than or equal to 1 mm. The thickness of the side wall portion is measured along the up-down direction.

From the viewpoint of reducing the rigidity of the frame body m1 of the head body hb1 and facilitating bending of the hitting face 102, the sole wall portion 160 has a thickness of preferably less than or equal to 4 mm, more preferably less than or equal to 3 mm, and still more preferably less than or equal to 2.5 mm. From the viewpoint of strength, the thickness of the sole wall portion 160 is preferably greater than or equal to 0.5 mm, and more preferably greater than or equal to 1 mm. The thickness of the sole wall portion is measured along the up-down direction.

From the viewpoint of reducing the rigidity of the frame body m1 of the head body hb1 and facilitating bending of the hitting face 102, the thickness of the extension portion 150 is preferably less than or equal to 4 mm, more preferably less than or equal to 3 mm, and still more preferably less than or equal to 2.5 mm. From the viewpoint of strength, the thickness of the extension portion 150 is preferably greater than or equal to 0.5 mm, and more preferably greater than or equal to 1 mm. The thickness of the extension portion is measured along the up-down direction.

From the viewpoint of reducing the rigidity of the frame body m1 of the head body hb1 and facilitating bending of the hitting face 102, the top wall portion 360 (FIG. 18) has a thickness of preferably less than or equal to 4 mm, more preferably less than or equal to 3 mm, and still more preferably less than or equal to 2.5 mm. From the viewpoint of strength, the thickness of the top wall portion 360 is preferably greater than or equal to 0.5 mm, and more preferably greater than or equal to 1 mm. The thickness of the top wall portion is measured along the up-down direction.

A double-pointed arrow W1 in FIG. 10 indicates an opening width of the body groove 144. From the viewpoint of ease of deformation of the frame body m1, the opening width W1 is preferably greater than or equal to 0.5 mm, more preferably greater than or equal to 1 mm, and still more preferably greater than or equal to 1.5 mm. Considering the dimensions of the head, the opening width W1 is preferably less than or equal to 5 mm, more preferably less than or equal to 4 mm, and still more preferably less than or equal to 3 mm. The opening width W1 is measured along the up-down direction.

A double-pointed arrow D1 in FIG. 10 indicates a depth of the body groove 144. From the viewpoint of ease of deformation of the frame body m1, the depth D1 is preferably greater than or equal to 0.5 mm, more preferably greater than or equal to 1 mm, and still more preferably greater than or equal to 1.5 mm. Considering the dimensions of the head, the depth D1 is preferably less than or equal to 10 mm, more preferably less than or equal to 9 mm, and still more preferably less than or equal to 8 mm. The depth D1 is measured along the face-back direction.

A double-pointed arrow D2 in FIG. 10 indicates a length of the thin portion 174. From the viewpoint of ease of deformation of the frame body m1, the length D2 is preferably greater than or equal to 1.5 mm, more preferably greater than or equal to 2 mm, and still more preferably greater than or equal to 2.5 mm. Considering the dimensions of the head, the length D2 is preferably less than or equal to 12 mm, more preferably less than or equal to 11 mm, and still more preferably less than or equal to 10 mm. The length D2 is measured along the face-back direction.

From the viewpoint of reducing the rigidity of the frame body m1 and enhancing the rebound performance, the back support portion in the abutting region Rc has a thickness of preferably less than or equal to 4 mm, more preferably less than or equal to 3 mm, and still more preferably less than or equal to 2.5 mm. Considering strength, the thickness of the back support portion in the abutting region Rc is preferably greater than or equal to 0.5 mm, more preferably greater than or equal to 1 mm, and still more preferably greater than or equal to 1.2 mm. This thickness is measured along the face-back direction.

A double-pointed arrow L1 in FIG. 5 indicates a length of the body groove 144. From the viewpoint of rebound performance, the length L1 of the body grooves 144 and 344 is preferably greater than or equal to 10 mm, more preferably greater than or equal to 15 mm, still more preferably greater than or equal to 20 mm, and yet still more preferably greater than or equal to 30 mm. Considering the dimensions of the head, the length L1 of the body grooves 144 and 344 is preferably less than or equal to 70 mm, more preferably less than or equal to 60 mm, and still more preferably less than or equal to 55 mm. The length L1 of the body groove 144 is measured along the toe-heel direction.

Figure 20:
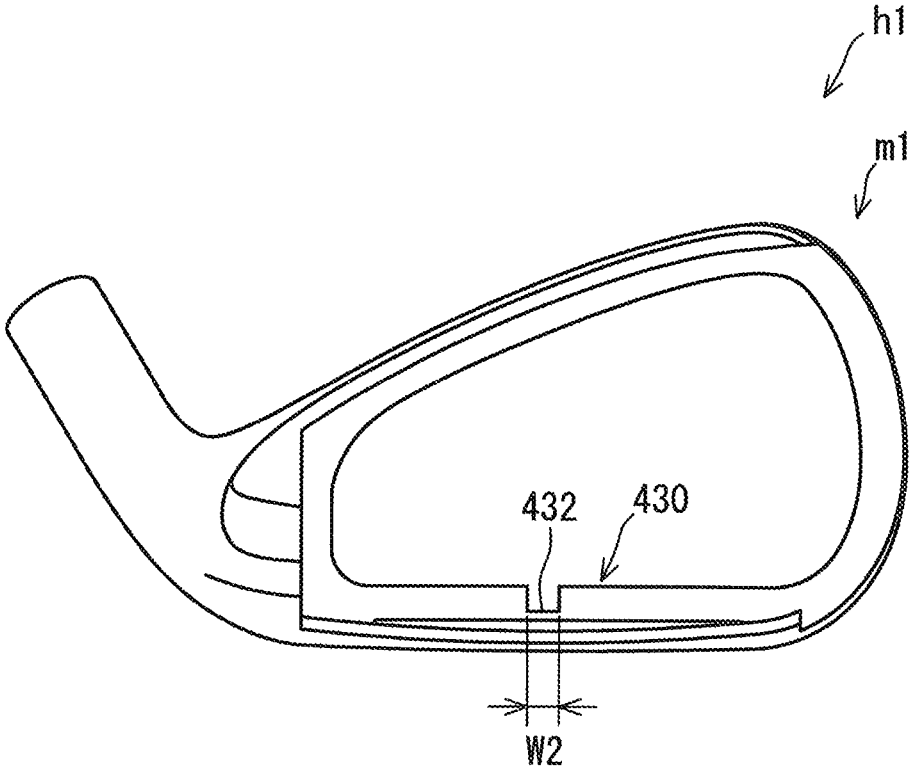
FIG. 20 is a back view of a first member according to a fourth embodiment.

FIG. 20 is a back view of a first member h1 according to a fourth embodiment. The first member h1 includes a back support portion 430. The back support portion 430 is provided with an aperture portion 432. The aperture portion 432 is formed such that a part of the back support portion 430 is absent. In the present embodiment, the number of the aperture portion 432 is 1. Except for the presence of the aperture portion 432, the configuration of the head according to the fourth embodiment is the same as that of the head 100 described above.

Because of the aperture portion 432, a part of the outer peripheral edge portion of the face plate f1 is not supported by the back support portion 430. Further, the aperture portion 432 reduces the rigidity of the back support portion 430. As a result, deformation of the face plate f1 becomes large, and the rebound performance is enhanced.

In the fourth embodiment, the aperture portion 432 is provided at the position corresponding to the face center. In other words, the scope of presence in the toe-heel direction of the aperture portion 432 includes the position in the toe-heel direction of the face center. The aperture portion 432 enhances the rebound performance when hitting is performed on the lower side of the face center.

Figure 21:
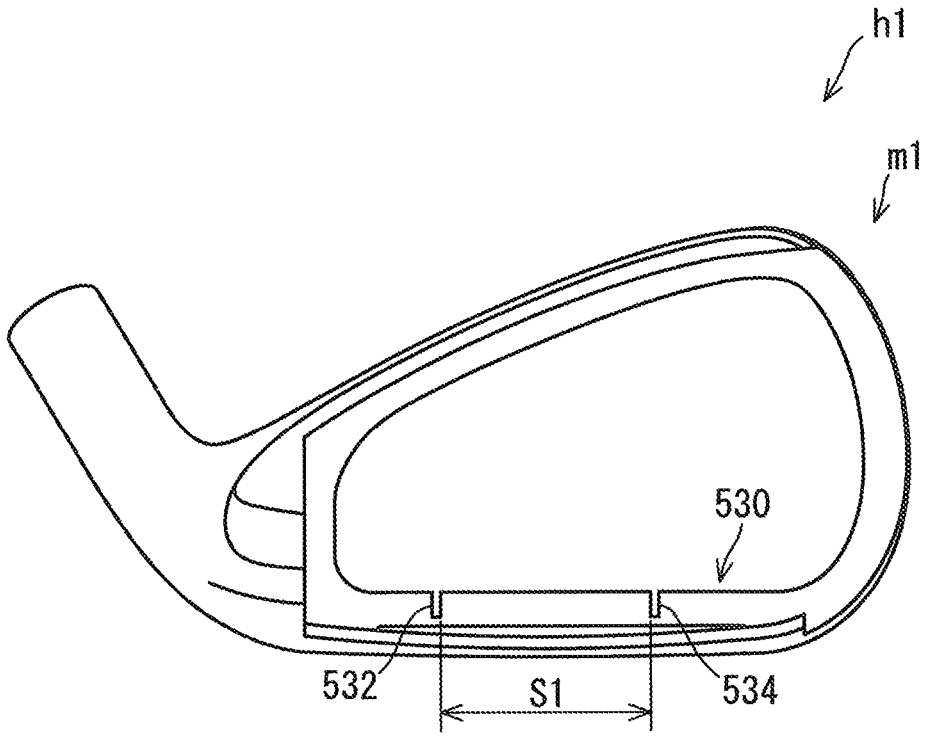
FIG. 21 is a back view of a first member according to a fifth embodiment.

FIG. 21 is a back view of a first member h1 according to a fifth embodiment. The first member h1 includes a back support portion 530. Except for the presence of aperture portions described later, the head according to the fifth embodiment is the same as the head 100 described above.

In the present embodiment, a plurality of aperture portions are provided. The back support portion 530 is provided with a first aperture portion 532 and a second aperture portion 534. The first aperture portion 532 is provided on the heel side relative to the second aperture portion 534. The first aperture portion 532 is provided on the heel side relative to the face center. The second aperture portion 534 is provided on the toe side relative to the face center. The aperture portions 532 and 534 reduce the rigidity of the back support portion 530. The rigidity of a portion between the first aperture portion 532 and the second aperture portion 534 is particularly effectively reduced. As a result, deformation of the back support portion 530 becomes large to improve the rebound performance.

A double-pointed arrow S1 in FIG. 21 indicates an interval distance between the aperture portions. When a plurality of aperture portions are provided, the interval distance S1 between at least one pair of adjacent aperture portions is preferably greater than or equal to 10 mm, and more preferably greater than or equal to 15 mm. When the interval distance S1 is set to be large, the back support portion which is present between the aperture portions is made longer. This portion between the aperture portions easily deforms, and contributes to improvement of the rebound performance. Considering the dimensions of the head, the interval distance S1 is preferably less than or equal to 80 mm.

A double-pointed arrow W2 in FIG. 20 indicates a width of the aperture portion. From the viewpoint of rebound performance, the width W2 of the aperture portion is preferably greater than or equal to 1 mm. Considering strength, the width W2 of the aperture portion is preferably less than or equal to 15 mm. When the back support portion is located in the sole-side region, the width W2 of the aperture portion is measured along the toe-heel direction.

From the viewpoint of rebound performance, the aperture portion is preferably provided in a presence scope Rg of the longest face line gv1. As shown in FIG. 1, the presence scope Rg of the longest face line gv1 is a scope in the toe-heel direction and ranges from a toe-side end Pt of the longest face line gv1 to a heel-side end Ph of the longest face line gv1. The aperture portion 432, and the aperture portions 532 and 534 are provided in the presence scope Rg of the longest face line gv1.

As long as the back support portion does not fall off, the aperture portion may be formed over the entirety in the height direction of the back support portion. In other words, the aperture portion may extend from the end on the face center side of the back support portion to the end on the face peripheral side of the back support portion. The aperture portion located in the sole-side region may extend from the upper end of the back support portion to the lower end of the back support portion. As with the aperture portions 432, 532 and 534, the aperture portion may end without reaching the end on the face peripheral side of the back support portion.

In the head 100 described above, the back support portion 130 is provided over the entire periphery of the opening 120. The back support portion 130 which is continuous to have an annular shape is less likely to deform. When the aperture portion is provided in the back support portion 130, the rigidity of the back support portion 130 can be effectively reduced.

Figure 22:
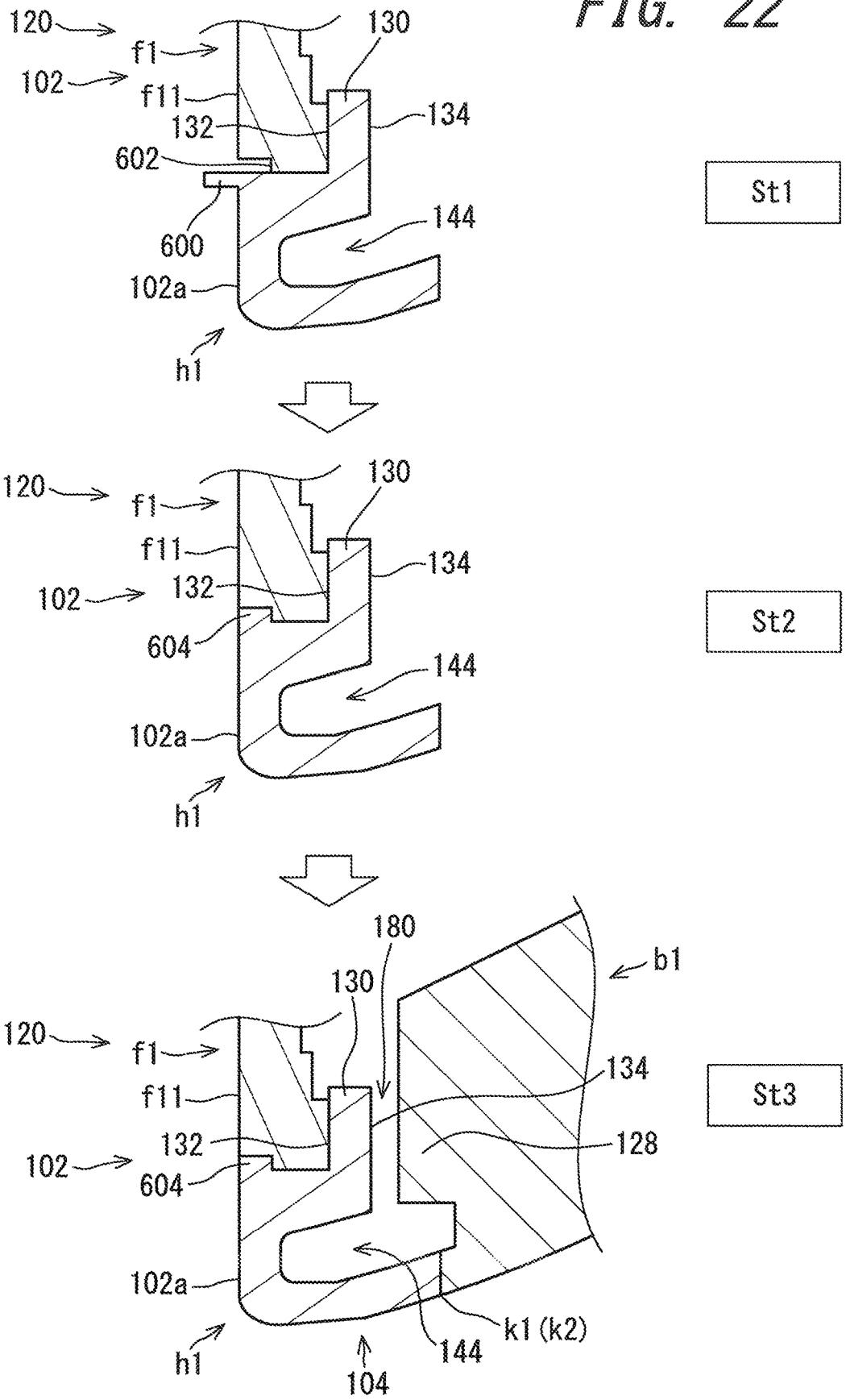
FIG. 22 is a process drawing showing a method for producing the head of the first embodiment.

FIG. 22 is a process drawing showing a method for producing the head 100. In a state where the face plate f1 is not yet attached to the first member h1, the first member h1 includes a caulking protrusion 600. The caulking protrusion 600 is a protruding portion (wall portion) provided along the outer edge of the opening 120. The caulking protrusion 600 is provided on the hitting face 102. Meanwhile, the plate front surface f11 of the face plate f1 includes a step portion 602 on the outer edge of the plate front surface f11. In the step portion 602, the plate front surface f11 is recessed.

This production method includes the following steps (see FIG. 22).

(1) First step St1 of placing the face plate f1 at the opening 120 of the first member h1.

(2) Second step St2 of forming a holding portion 604 on the face side of the step portion 602 by plastically deforming the caulking protrusion 600.

(3) Third step St3 of joining the second member b1 to the first member h1.

The second step St2 is performed after the first step St1. The third step St3 is performed after the second step St2.

The second step St2 is also referred to as a caulking process. In this caulking process, the caulking protrusion 600 is squashed. In the caulking process, the face plate f1 is pressed. This pressing force is transmitted to the back receiving surface 132. In the caulking process, the back receiving surface 132 is pressed by the face plate f1.

In the caulking process, the caulking protrusion 600 is squashed and the face plate f1 is also pressed. When the face plate f1 is pressed, the back support portion 130 is pressed.

In this way, the head 100 is produced by a method including the following process Y.

[Process Y] Process in which the back receiving surface 132 is pressed by the face plate f1.

The above caulking process is an example of the process Y.

In the process Y, the back support portion 130 is pressed by the face plate f1. Thus, the back support portion 130 requires rigidity and strength for enduring this pressing force. From this viewpoint, a structure such as the back support portion 402 in FIG. 19 is preferable. However, in this case, the head body hb1 is less likely to deform at impact, which results in reduced rebound performance.

The process Y is performed on the first member h1 before the second member b1 is attached thereto. As described above, the second member b1 includes the rearward disposed portion 128 to be located on the back side of the rear surface 134. The rearward disposed portion 128 becomes an obstacle to supporting the rear surface 134 from the back side. In this production method, the process Y is performed in a state where the second member b1 including the rearward disposed portion 128 is absent, and thus the rear surface 134 can be easily supported from the back side. Therefore, even when the rigidity of the back support portion 130 is low, the process Y can be smoothly performed.

Therefore, the head 100 is preferably produced by a method including the following process Y1.

[Process Y1]: Process in which the back receiving surface 132 is pressed by the face plate f1 while the rear surface 134 is supported by a jig.

The process Y1 is preferably performed on the first member h1 to which the second member b1 is not yet attached.

The head in which the face plate f1 is fixed to the head body hb1 by caulking is produced by a method that essentially includes the process Y. Therefore, in this head, the head body hb1 preferably includes the first member h1 and the second member b1.

The process Y is not limited to the caulking process. For example, a head in which the face plate f1 is press-fitted into the opening 120 of the first member h1 is produced by a method including the process Y. In this head, the face plate f1 is press-fitted into the opening of the first member h1 in the step St1. In this press-fitting, the face plate f1 is fitted into the opening 120 in a state where the opening inner surface 122 is pressed by the plate side surface f13. Also in this head, the head body hb1 preferably includes the first member h1 and the second member b1.

A head in which the face plate f1 is adhered to the back receiving surface 132 with an adhesive is produced by a method including the process Y, because, in this adhesion, the adhesive is hardened in a state where the face plate f1 is pressed against the back receiving surface 132. Therefore, also in this head, the head body hb1 preferably includes the first member h1 and the second member b1. This adhesion is employed preferably when the material of the face plate f1 is a non-metal such as an FRP (fiber reinforced plastic).

A head in which the face plate f1 is pressed to join with the back receiving surface 132 is produced by a method including the process Y. Therefore, also in this head, the head body hb1 preferably includes the first member h1 and the second member b1.

The face plate f1 has a specific gravity of preferably smaller than the specific gravity of the head body hb1. The specific gravity of the face plate f1 is preferably smaller than the specific gravity of the first member h1. The smaller specific gravity of the face plate f1 improves the degrees of freedom in weight distribution of the head and design for the center of gravity of the head. In addition, a weight can be distributed to the peripheral side of the head, and the moment of inertia of the head can be increased.

The face plate f1 has a material strength of preferably greater than the material strength of the head body hb1. The material strength of the face plate f1 is preferably greater than the material strength of the first member h1. Such a high-strength material used for the face plate f1 enables the face plate f1 to be thinner. Such a thinner face plate f1 can reduce the rigidity of the face plate f1 and can increase bending deformation of the face plate f1. Such a large bending deformation enhances the rebound performance. Note that the material strength can be defined as a tensile strength measured by a tensile testing specified in JIS Z 2241. In this tensile testing, the test piece can be No. 4 test piece.

EXAMPLES

Example

A head that was the same as the head 100 of the first embodiment was produced. The first member h1 was produced by casting (lost-wax precision casting). The material of the first member h1 was stainless steel. The face plate f1 was produced by subjecting a rolled material to NC machining. The material of the face plate f1 was a titanium alloy. The second member b1 was produced by casting (lost-wax precision casting). The material of the second member b1 was stainless steel. The weight wt was produced by powder sintering. The material of the weight wt was a tungsten-nickel alloy. The weight wt was fixed with an adhesive to a weight pocket provided on the second member b1.

While the back support portion 130 was supported by a jig from the back side, the face plate f1 was press-fitted into the opening 120 of the first member h1. Next, while the back support portion 130 was supported by the jig from the back side, the caulking protrusion 600 of the first member h1 was plastically deformed to form the holding portion 604 on the face side of the step portion 602. Then, the second member b1 was welded to the first member h1, and surface finishing such as polishing was performed to obtain a head. The head was a number 6 iron.

Comparative Example

A head that was the same as the head 400 shown in FIG. 19 was produced. The head of Comparative Example was obtained in the same manner as in Example except that the head body hb1 had the same structure as that shown in FIG. 19.

[Evaluation]

Values of COR for the respective heads were measured at 3 points: the face center (point FC); a point (point D5) separated by 5 mm toward the lower side from the face center; and a point (point D10) separated by 10 mm toward the lower side from the face center. The COR means a coefficient of restitution. The COR was measured according to "Interim Procedure for Measuring the Coefficient of Restitution of an Iron Clubhead Relative to a Baseline Plate Revision 1.3 Jan. 1, 2006" specified by USGA (United States Golf Association).

In each of Example and Comparative Example, ratios (%) of the measured CORs to the COR measured at the face center were as follows.

Example

Point FC: 100%
Point D5: 103%
Point D10: 104%

Comparative Example

Point FC: 100%
Point D5: 101%
Point D10: 99%

Thus, the reduction rate of the COR at the hitting point on the lower side in Example was smaller than that in Comparative Example.

The following clauses are disclosed regarding the above-described embodiments.

[Clause 1]

A golf club head including:
a head body including a sole; and
a face plate fixed to the head body, wherein
the face plate includes:
a plate front surface forming a part of a hitting face; and
a plate rear surface that is a surface opposite to the plate front surface, and
the head body includes:
an opening at which the face plate is disposed;
a back support portion that includes a back receiving surface abutting on an outer peripheral edge portion of the plate rear surface and that supports the face plate from a back side;
a face outer portion that is a part of the hitting face and that is located on a face peripheral side relative to the plate front surface; and
a body groove that is located on the back side of the face outer portion and that is recessed toward the face outer portion.

[Clause 2]

The golf club head according to clause 1, wherein
the face outer portion is a face lower portion that is located on a lower side relative to the face plate, and
the body groove is located on the back side of the face lower portion.

[Clause 3]

The golf club head according to clause 1 or 2, wherein
the golf club head is an iron-type golf club head.

[Clause 4]

The golf club head according to any one of clauses 1 to 3, wherein
the body groove is recessed to reach a position located on a face side relative to the back receiving surface.

[Clause 5]

The golf club head according to any one of clauses 1 to 4, wherein
a slit having a predetermined width in a face-back direction is further formed on the back side of the back support portion, and
the slit forms a space continuous with an internal space of the body groove.

[Clause 6]

The golf club head according to clause 5, wherein
the head body includes a rearward disposed portion located on the back side of the slit, and
the hitting face includes a specific measurement point, a measurement of a COR at the specific measurement point bringing the back support portion into contact with the rearward disposed portion.

[Clause 7]

The golf club head according to any one of clauses 1 to 6, wherein
the head body includes:
a first member that includes the back support portion, the face plate being fixed to the first member; and
a second member joined to the first member, and
the second member includes a rearward disposed portion that is disposed on the back side of the back support portion.

The above description is merely an example, and various changes can be made without departing from the essence of the present disclosure.

What is claimed is:

1. A golf club head comprising:
a head body including a sole; and
a face plate fixed to the head body, wherein
the face plate includes:
a plate front surface forming a part of a hitting face; and
a plate rear surface that is a surface opposite to the plate front surface, and
the head body includes:
an opening at which the face plate is disposed;
a back support portion that includes a back receiving surface abutting on an outer peripheral edge portion of the plate rear surface and that supports the face plate from a back side;
a face outer portion that is a part of the hitting face and that is located on a face peripheral side relative to the plate front surface; and
a body groove that is located on a back side of the face outer portion and that is recessed toward the face outer portion, wherein
the face outer portion includes a face lower portion that is located on a lower side relative to the face plate, and the body groove is only located on the back side of the face lower portion.

2. The golf club head according to claim 1, wherein
the golf club head is an iron-type golf club head.

3. The golf club head according to claim 1, wherein
the body groove is recessed to reach a position located on a face side relative to the back receiving surface.

4. The golf club head according to claim 1, wherein
a slit having a predetermined width in a face-back direction is further formed on a back side of the back support portion, and
the slit forms a space continuous with an internal space of the body groove.

5. The golf club head according to claim 4, wherein
the head body includes a rearward disposed portion located on the back side of the slit, and
the hitting face includes a specific measurement point, a measurement of a COR at the specific measurement point bringing the back support portion into contact with the rearward disposed portion.

6. The golf club head according to claim 4, wherein
the golf club head further includes a back cavity, and
the space formed by the slit is continuous with the back cavity.

7. The golf club head according to claim 1, wherein
the head body includes:
a first member that includes the back support portion, the face plate being fixed to the first member; and
a second member joined to the first member, and
the second member includes a rearward disposed portion that is disposed on the back side of the back support portion.

8. The golf club head according to claim 1, wherein
a clearance is provided on the back side of the back support portion.

9. The golf club head according to claim 1, wherein
the body groove extends from a point located on a heel side relative to a face center, to a point located on a toe side relative to the face center.

10. The golf club head according to claim 9, wherein
the body groove has a length in a toe-heel direction of greater than or equal to 10 mm and less than or equal to 70 mm.

11. The golf club head according to claim 1, wherein
the body groove has an opening width of greater than or equal to 0.5 mm and less than or equal to 5 mm.

12. The golf club head according to claim 1, wherein
the body groove has a depth of greater than or equal to 0.5 mm and less than or equal to 10 mm.

13. The golf club head according to claim 1, wherein
a front wall portion is formed between the face outer portion and the body groove, and
the front wall portion has a thickness of greater than or equal to 0.5 mm and less than or equal to 4 mm.

14. The golf club head according to claim 1, wherein
a sole wall portion is formed between the body groove and an outer surface of the sole, and
the sole wall portion has a thickness of greater than or equal to 0.5 mm and less than or equal to 4 mm.

15. The golf club head according to claim 14, wherein
the head body further includes an extension portion continuous with the sole wall portion and extending from the sole wall portion toward a back side, and
the extension portion has a thickness of greater than or equal to 0.5 mm and less than or equal to 4 mm.

16. A golf club head comprising:
a head body including a sole; and
a face plate fixed to the head body, wherein
the face plate includes:
a plate front surface forming a part of a hitting face; and
a plate rear surface that is a surface opposite to the plate front surface, and
the head body includes:
an opening at which the face plate is disposed;
a back support portion that includes a back receiving surface abutting on an outer peripheral edge portion of the plate rear surface and that supports the face plate from a back side;
a face outer portion that is a part of the hitting face and that is located on a face peripheral side relative to the plate front surface; and
a body groove that is located on a back side of the face outer portion and that is recessed toward the face outer portion, wherein
the head body includes:
a first member that includes the back support portion, the face plate being fixed to the first member; and
a second member, originally separate member from the first member, joined to the first member, and
the second member includes a rearward disposed portion that is disposed on the back side of the back support portion.

17. The golf club head according to claim 16, wherein the first member includes a sole wall portion that is formed between the body groove and an outer surface of the sole, and an extension portion that extends from the sole wall portion toward a back side, and
the extension portion includes a rear end surface that is joined to the second member.

18. A golf club head comprising:
a head body including a sole; and
a face plate fixed to the head body, wherein
the face plate includes:
a plate front surface forming a part of a hitting face; and
a plate rear surface that is a surface opposite to the plate front surface, and
the head body includes:
an opening at which the face plate is disposed;
a back support portion that includes a back receiving surface abutting on an outer peripheral edge portion of the plate rear surface and that supports the face plate from a back side;
a face outer portion that is a part of the hitting face and that is located on a face peripheral side relative to the plate front surface; and
a body groove that is located on a back side of the face outer portion and that is recessed toward the face outer portion, wherein
a slit having a predetermined width in a face-back direction is formed on a back side of the back support portion, and the slit forms a space continuous with an internal space of the body groove; and
the body groove is recessed to reach a position located on a back side relative to the slit in the face-back direction.

* * * * *